US009598905B2

(12) United States Patent
Van Zee et al.

(10) Patent No.: US 9,598,905 B2
(45) Date of Patent: Mar. 21, 2017

(54) TWO PIPE HORIZONTAL DIRECTIONAL DRILLING SYSTEM

(71) Applicant: Vermeer Manufacturing Company, Pella, IA (US)

(72) Inventors: Michael D. Van Zee, Pella, IA (US); Ryan D. Otis, Waverly, IA (US); Clint M. Recker, Pella, IA (US); David Wisniewski, Pella, IA (US); Robin W. Carlson, Laramie, WY (US)

(73) Assignee: Vermeer Manufacturing Company, Pella, IA (US)

( * ) Notice: Subject to any disclaimer, the term of this patent is extended or adjusted under 35 U.S.C. 154(b) by 864 days.

(21) Appl. No.: 13/676,797

(22) Filed: Nov. 14, 2012

(65) Prior Publication Data

US 2013/0068490 A1 Mar. 21, 2013

Related U.S. Application Data

(63) Continuation of application No. PCT/US2011/036817, filed on May 17, 2011.
(Continued)

(51) Int. Cl.
*E21B 7/04* (2006.01)
*E21B 19/00* (2006.01)
(Continued)

(52) U.S. Cl.
CPC ..... *E21B 7/04* (2013.01); *E21B 3/02* (2013.01); *E21B 7/02* (2013.01); *E21B 7/046* (2013.01);
(Continued)

(58) Field of Classification Search
CPC ..... E21B 15/04; E21B 17/021; E21B 17/18; E21B 19/00; E21B 19/02; E21B 19/08;
(Continued)

(56) References Cited

U.S. PATENT DOCUMENTS 5,060,542 A * 10/1991 Hauk ..... 81/57.34
5,386,746 A * 2/1995 Hauk ..... 81/57.34
(Continued)

FOREIGN PATENT DOCUMENTS

WO WO 2009/052298 A1 4/2009

OTHER PUBLICATIONS

International Search Report for corresponding International Patent Application No. PCT/US2011/036817 mailed Nov. 4, 2011.
(Continued)

*Primary Examiner* — Thanh Truong
*Assistant Examiner* — Thomas Wittenschlaeger
(74) *Attorney, Agent, or Firm* — Merchant & Gould P.C.

(57) ABSTRACT

The present disclosure provides a drill drive unit and drill string make up and break up unit with a method for use with a dual pipe drill string configuration. The drill drive unit is mounted to a single carriage and includes an outer drive spindle in a position fixed to the carriage with inner drive spindle configured to rotate independent of the outer drive spindle while being able to move longitudinally at least 12 inches relative to the outer drive spindle. The method involves connecting and disconnecting inner shafts and outer shafts of the dual pipe drill string.

22 Claims, 29 Drawing Sheets

Related U.S. Application Data

(60) Provisional application No. 61/345,497, filed on May 17, 2010.

(51) Int. Cl.
*E21B 3/02* (2006.01)
*E21B 7/02* (2006.01)
*E21B 17/18* (2006.01)

(52) U.S. Cl.
CPC ..... *E21B 17/18* (2013.01); *E21B 19/00* (2013.01); *Y10T 29/49815* (2015.01)

(58) Field of Classification Search
CPC ..... E21B 19/083; E21B 19/14; E21B 19/16; E21B 19/161; E21B 19/162; E21B 19/163; E21B 19/164; E21B 19/167; E21B 19/168; E21B 19/18; E21B 19/20; E21B 19/22; E21B 19/24; E21B 3/02; E21B 7/02; E21B 7/04; E21B 7/046; E21B 7/06; Y10T 29/49815
See application file for complete search history.

(56) References Cited

U.S. PATENT DOCUMENTS 5,682,956 A * 11/1997 Deken ..... E21B 6/00 175/19
6,164,391 A * 12/2000 Wurm ..... E21B 19/20 175/52
RE38,418 E * 2/2004 Deken et al. ..... 175/19
6,702,043 B2 * 3/2004 Koch ..... E21B 19/20 175/52
7,216,724 B2 * 5/2007 Self ..... E21B 7/046 175/19
2002/0084109 A1 7/2002 Runquist et al.
2002/0178871 A1 * 12/2002 Hauk et al. ..... 81/57.16
2003/0056623 A1 * 3/2003 Carlson ..... E21B 19/18 81/57.16
2003/0132030 A1 * 7/2003 Tompkins ..... E21B 19/20 175/52
2005/0133264 A1 6/2005 Glas et al.
2006/0137910 A1 * 6/2006 Hamner ..... 175/52
2007/0119623 A1 * 5/2007 Sewell ..... E21B 7/046 175/52
2007/0209838 A1 * 9/2007 Kraus ..... E21B 19/20 175/52
2008/0073123 A1 * 3/2008 Mullins ..... E21B 7/046 175/62
2008/0185185 A1 * 8/2008 Mitchell ..... E21B 19/165 175/27
2009/0014215 A1 1/2009 Hartke
2009/0095526 A1 * 4/2009 Lane ..... E21B 19/083 175/24

OTHER PUBLICATIONS

International Search Report for corresponding International Patent Application No. PCT/US2010/026025 mailed Aug. 20, 2010.

* cited by examiner

TWO PIPE HORIZONTAL DIRECTIONAL DRILLING SYSTEM

This application is a Continuation of PCT/US2011/036817, filed 17 May 2011, which claims benefit of Ser. No. 61/345,497, filed 17 May 2010 in the United States and which applications are incorporated herein by reference. To the extent appropriate, a claim of priority is made to each of the above disclosed applications.

TECHNICAL FIELD

The present disclosure provides an apparatus and method for directional drilling.

BACKGROUND

Directional boring machines and methods for making underground holes are known. A typical directional boring machine is generally configured to drive into the ground a series of drill rods joined end-to-end to form a drill string. At the end of the drill string is a rotating drilling tool. Typically, the rotation of the drill tool is driven by a mud motor or by axially rotating the drill string itself. Various techniques and configurations can be used to provide steering of the drill string during boring operations. Improvements in directional boring machines, drill strings for use with such machines, and methods of directional drilling are needed.

SUMMARY

The present disclosure provides a drill drive unit and drill string make up and break up method for use with a dual pipe drill string configuration. The drill drive unit includes telescoping outer and inner drive shafts that are configured to rotate independent of each other. The method involves connecting and disconnecting inner shafts and outer shafts of the dual pipe drill string.

DETAILED DESCRIPTION

Figure 1A:
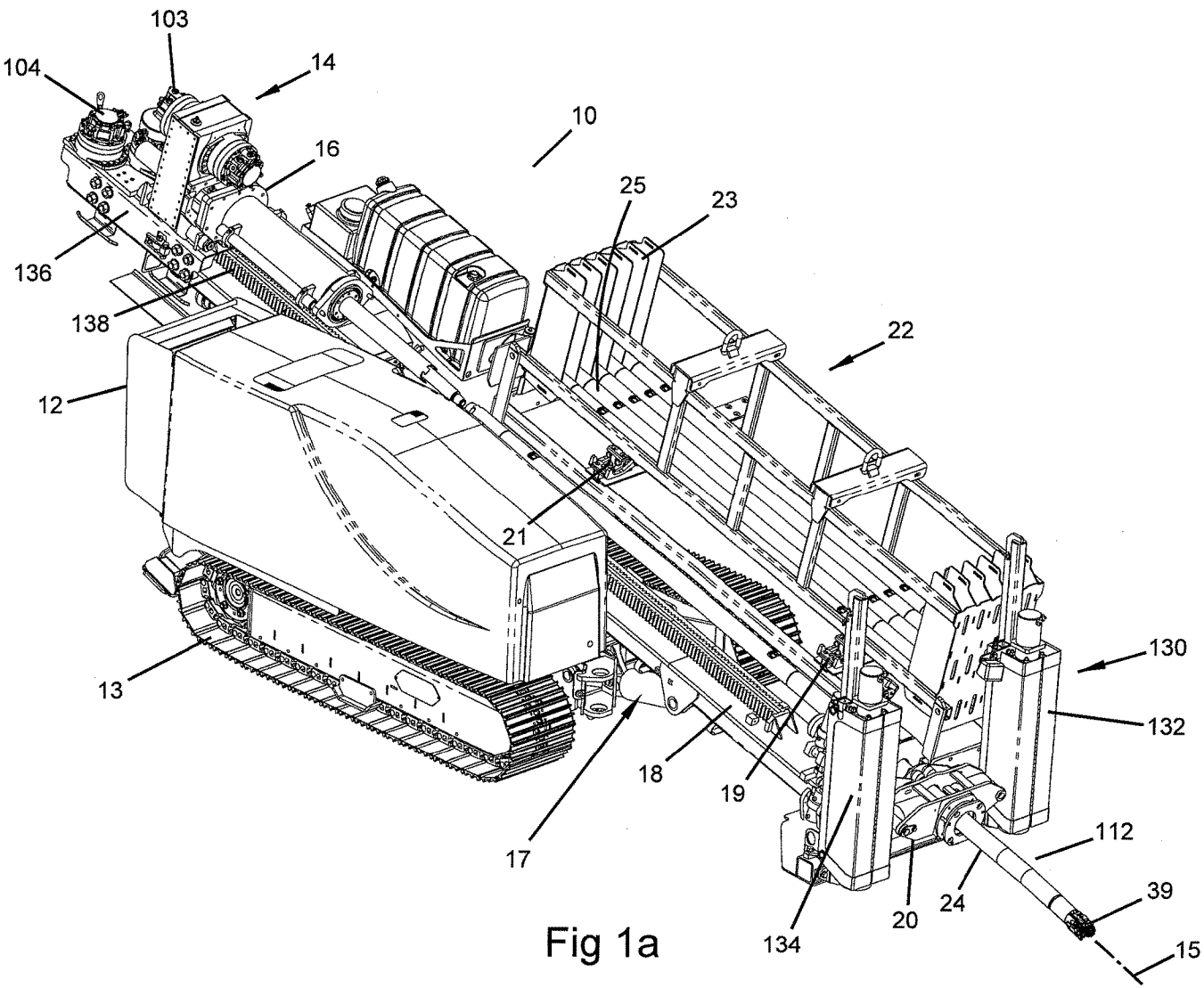
FIGS. 1A-B are perspective views of an embodiment of a drilling machine according to the present disclosure.
Figure 1B:
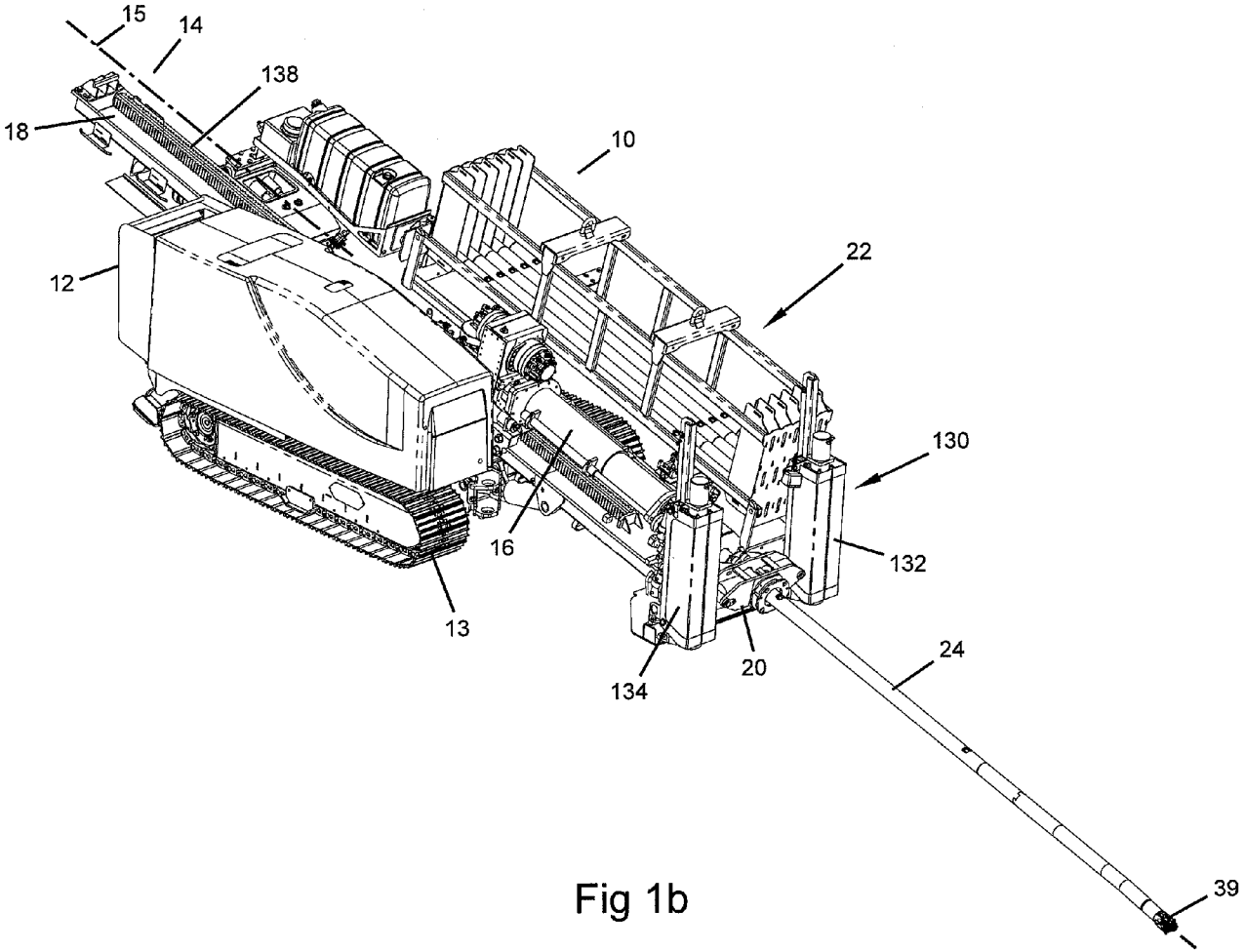

FIGS. 1A-B illustrate a example of a machine which can utilize various aspects of the present invention. This illustrated example shows a drilling machine configured primarily for horizontal surface boring, wherein the bore will enter the ground at an angle typically between 10 degrees and 30 degrees, as measured from the horizontal. The current invention is not limited to this configuration, and could be applied to drill machines configured for vertical boring, which typically include the same basic machine elements.

The basic elements of drilling machine 10, include a chassis 12, which in some embodiments is movably supported on wheels or tracks 13. The chassis 12 supports a drill string drive assembly 14 and a break out mechanism 20. The drilling machine 10 also includes a drill rod loading assembly 22. In the depicted embodiment the down hole end of the chassis 12 is connected to an anchoring mechanism 130 that secures the chassis to the ground, shown as a pair of stake downs 132, 134.

The drill string drive assembly 14 is configured to rotate the drill string 24 about a drill axis 15, and to push and pull drill string 24 by moving longitudinally along the rack. The drill string 24 is comprised of any number of individual drill rods 25 that have been connected end to end. The angle of the drill string drive assembly 14 relative to the ground surface can be adjusted via controlling a tilt mechanism 17 (e.g., hydraulic cylinder). In other words, the tilt control mechanism 17 can be used to control the vertical orientation of the drill string 24 as it is introduced into the ground. The drill rod loading assembly 22 is configured to transport drill rods 25 between the drill string drive assembly 14 and the drill rod storage unit.

In the depicted embodiment the drill rod loading assembly 22 is shown as a rod box configured to store the drill rods 25 in multiple vertical columns 23. A pair of load arms 19, 21 are provided at the lower end of the box for moving drill rods 25 from the rod box into alignment with the drill axis 15 during the drill string 24 insertion process (also referred to herein as rod add process) and from alignment with the drill axis 15 back to the rod box during the drill string 24 withdraw process (also referred to herein as the rod break out process or rod removal process).

Still referring to FIGS. 1A and 1B, the drill string drive assembly 14 of the depicted embodiment further includes a drive unit 16. The drill string drive unit 16 is configured to be driven towards the break out mechanism 20 to push a section of the drill string 24 into the ground, and be driven away from the break out mechanism 20 to pull a section of the drill string 24 from the ground. During the pushing and the pulling, the drill unit 16 can also rotate the drill string 24 about its longitudinal axis. In the depicted embodiment, the drill string drive assembly 14 includes a carriage 136 that engages a rack 138 on the frame 18. The carriage 136 supports the drive unit 16 and moves the drive unit 16 in an axial direction relative to the frame 18. In the depicted embodiment the carriage 136 includes two hydraulic motors 104, 103 that drive the movement of the carriage 136 along the rack 138.

The break out mechanism 20 is configured to hold the drill string 24 in place while sections of the drill string (drill rods 25) are added or removed. In the drill rod adding process, the break out mechanism 20 secures the upper end of the drill string 24 while the drill rod loading assembly 22 aligns the drill rod 25 that is to be added to the drill string 24 with the upper end of the drill string 24 and drive unit 16. For machines without rod loading mechanisms, the drill rod is held in alignment in an alternate method. Once the lower end of the newly added rod 25 is secured to the upper end of the drill string, the break out mechanism 20 releases the drill string 24, allowing the drive unit to rotate and push the drill string 24 further into the ground.

In the drill rod removal process, the break out mechanism 20 secures the upper end of the drill string 24 while the drill rod that is to be removed is broken free from the drill string 24 and transported out of alignment from the drill string 24 by the drill rod loading assembly 22. For machines without rod loading mechanisms, the drill rod is held in alignment in an alternate method. Once the rod is removed, the drive unit 16 moves down to the upper end of the drill string 24 and is connected thereto. The break out mechanism 20 then releases the end of the drill string 24, allowing the drive unit to rotate and pull the drill string 24 further out of the ground.

The present disclosure incorporates features of a drilling machine that are particularly beneficial for drilling systems wherein the drill string is a dual tube, pipe or rod configuration, wherein there is an outer member, and an inner member. The outer member is sometimes referred to as a casing, but in this disclosure it will be referred to as the outer rod or outer pipe, while the inner member will be referred to as an inner rod or inner pipe. In this document the drilling system will be referred to as a dual rod system.

In some cases each individual drill rod, before being connected to the drill string, is comprised of an inner rod and an outer rod. Alternative machines are configured to manipulate the outer rods and inner rods separately. The elements of the present invention and the methods of utilizing these components, will be described in the context of a machine configured to manipulate the rods as an assembly of an outer rod and an inner rod, but many of the features can be used with machines configured to manipulate the inner rods and outer rods separately.

Referring generally to FIGS. 2-7, an embodiment of the drilling machine 10 is shown. In the depicted embodiment the drill rod drive system 1000 includes a lower vise assembly 1400 (also referred to herein as a break out mechanism), a rack 1600, and a drill rod drive unit 1800.

The lower vise assembly 1400 includes a lower vise 2400, a middle vise 2600, and an upper vise 2800. In the depicted embodiment, the middle and upper vise assembly of the present embodiment include vises that are both configured to clamp and unclamp as well as move laterally along the rack 1600, as is illustrated by comparison of FIGS. 3 and 6, with the vises 2600 and 2800 in a position separated from the lower vise 2400, and FIGS. 4 and 7, with the vises 2600 and 2800 moved into an alternate position, adjacent the lower vise 2400.

Figure 19:
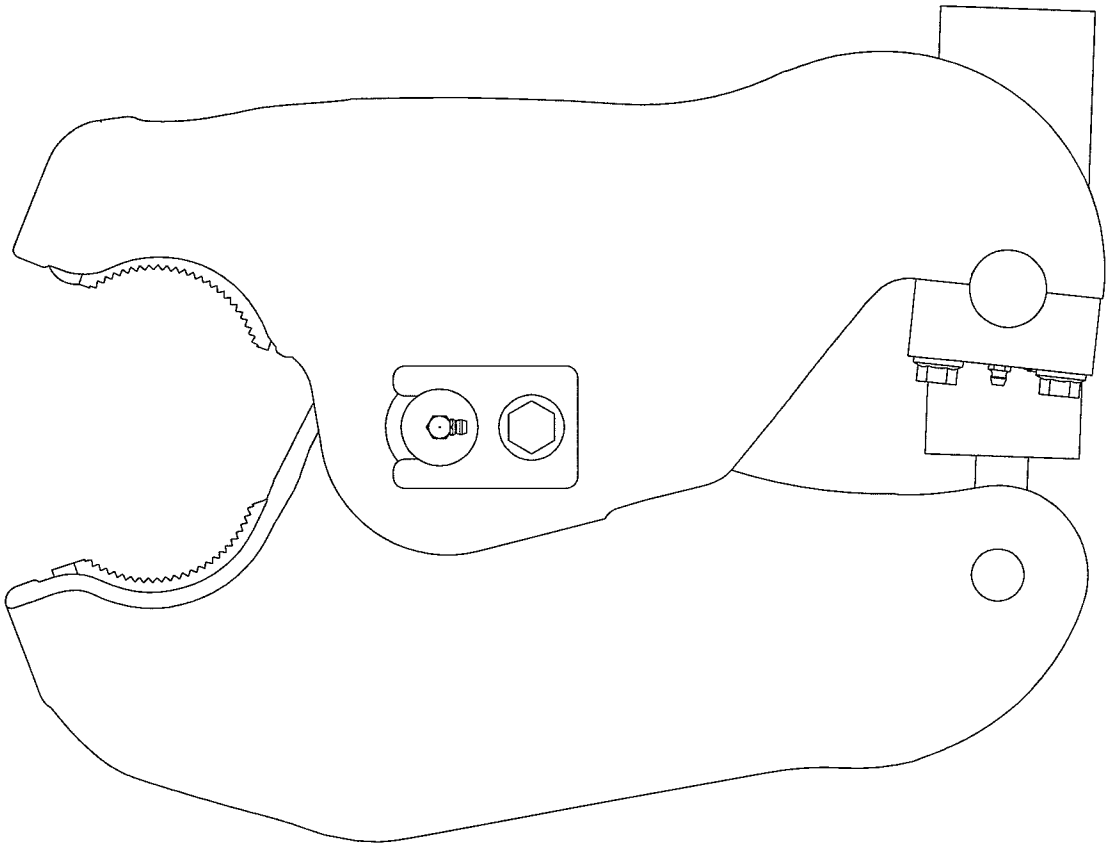
FIG. 19 is a schematic drawing of a typical vise.

Referring to FIG. 19, the vise mechanisms depicted in these illustrations are configured with vise arms that are actuated by vise clamp cylinders to force vise dies into engagement with the drill rods. There are many alternative designs for vises that perform similar function, including arrangements where a pair of clamp cylinders are positioned on opposite sides of the drill rod in order to move vise dies linearly into engagement with a drill rod. The present disclosure is not intended to be anyway limited to use with only the type of vises shown herein.

Figure 20:
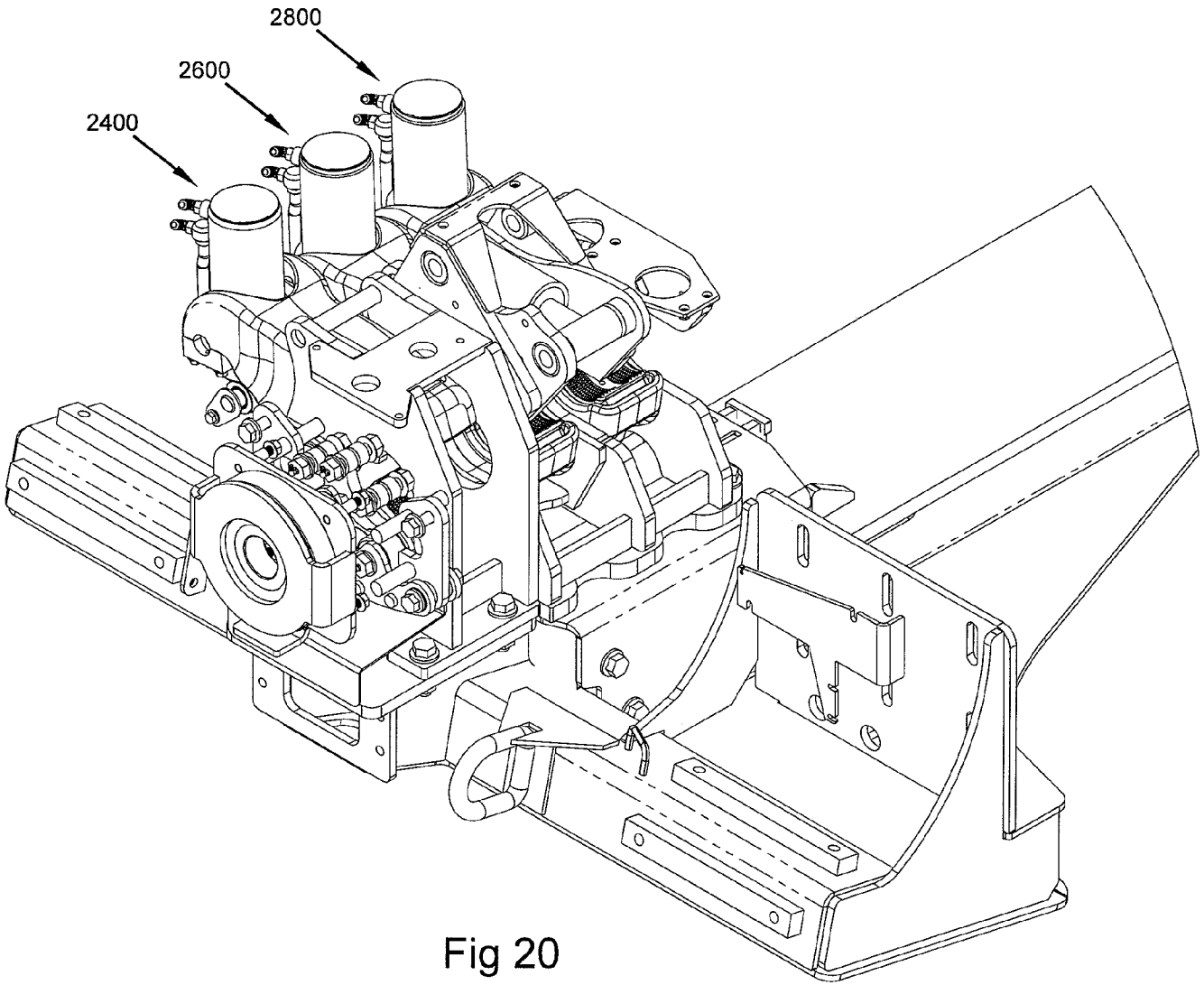
FIG. 20 is an isometric drawing of the vise assembly of the present disclosure in a first orientation.
Figure 21:
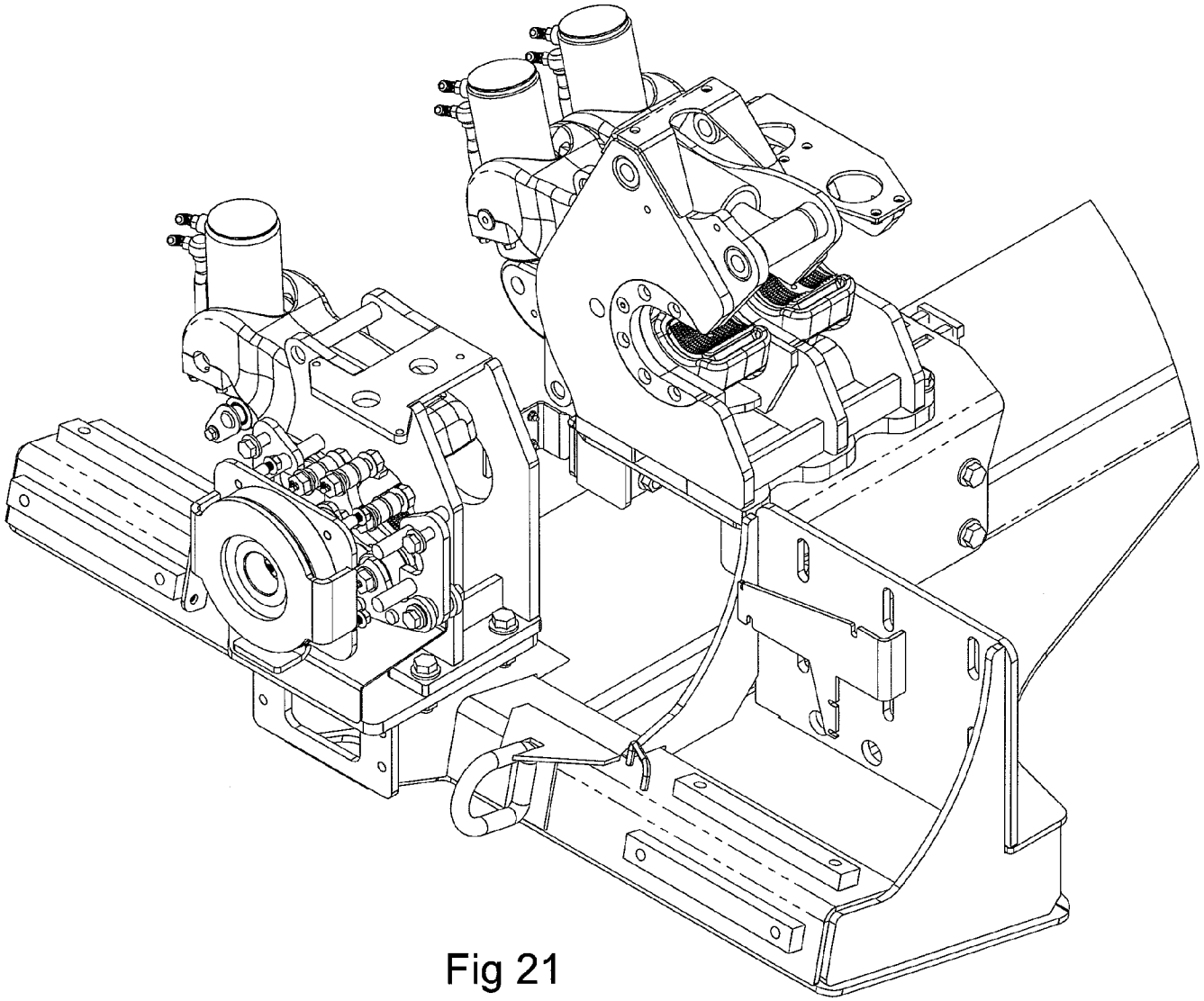
FIG. 21 is an isometric drawing of the vise assembly of the present disclosure in a second orientation.

Referring to FIGS. 20 and 21, the vise arrangement of the present disclosure is shown in more detail. The vise arrangement includes, as discussed above, a lower vise 2400, a middle vise 2600, and an upper vise 2800. The middle vise 2600 can be rotated relative to the other vises. The method of operation of the present invention, that will be described in more detail later in this document, has capabilities that are useful for different types of machines. The operations will be described in more detail, in the context of being used with the rod drive unit described herein, but the application of this vise arrangement is not intended to be limited to use with this drill rod drive mechanism.

The drill rod drive unit 1800 of the present invention includes a carriage 3000 that rides on the rack 1600, that supports both an inner rod drive assembly 3200, with an inner rod drive spindle for rotating inner rods of a dual rod drill string, and an outer rod drive assembly 3400, with an outer rod drive spindle for rotating outer rods of a dual rod drill string. The rod drive unit 1800 further includes a compensator assembly 3600 for extending the inner rod drive spindle relative to the outer rod drive spindle a distance adequate to assure proper operation of the overall system, as will be explained in more detail below.

Figure 5:
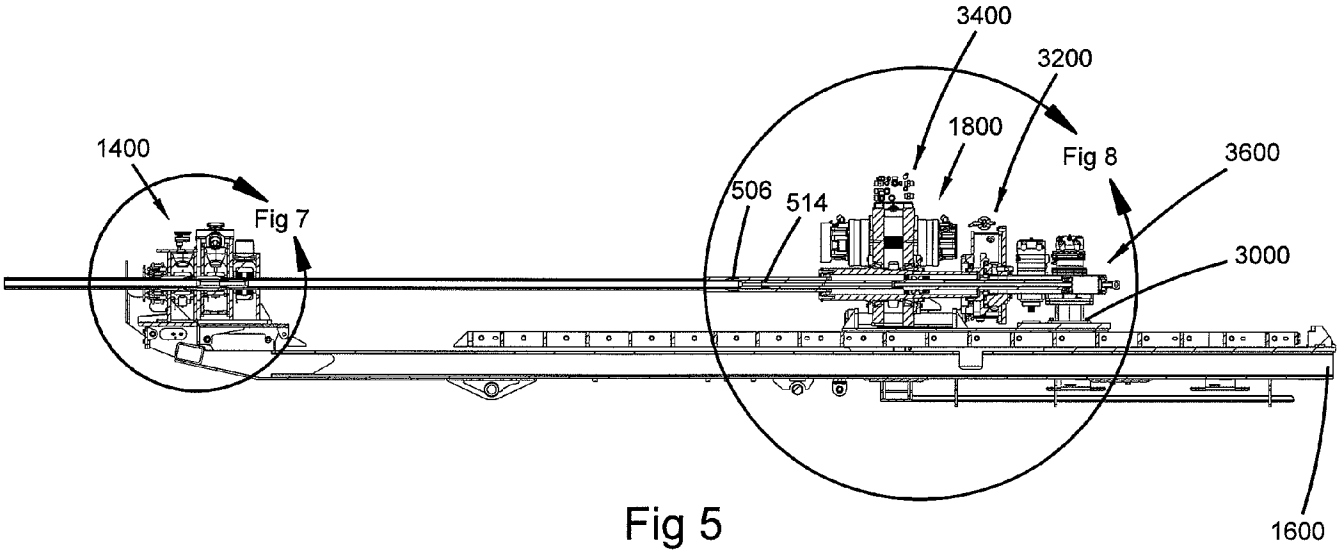
FIG. 5 is a cross-sectional view along lines 5-5 of FIG. 4.
Figure 6:
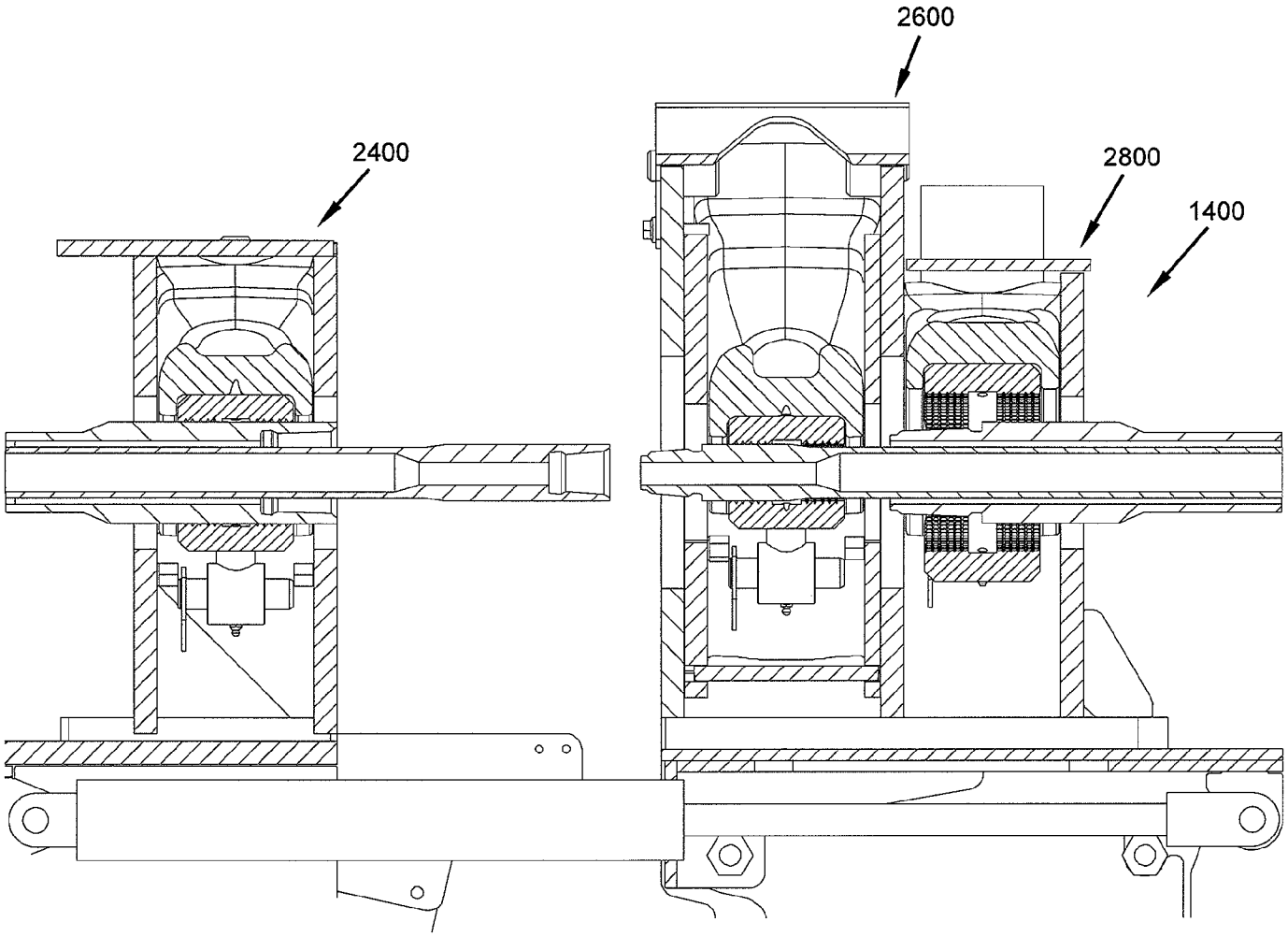
FIG. 6 is an enlarged cross-sectional view along lines 6-6 of FIG. 3.
Figure 7:
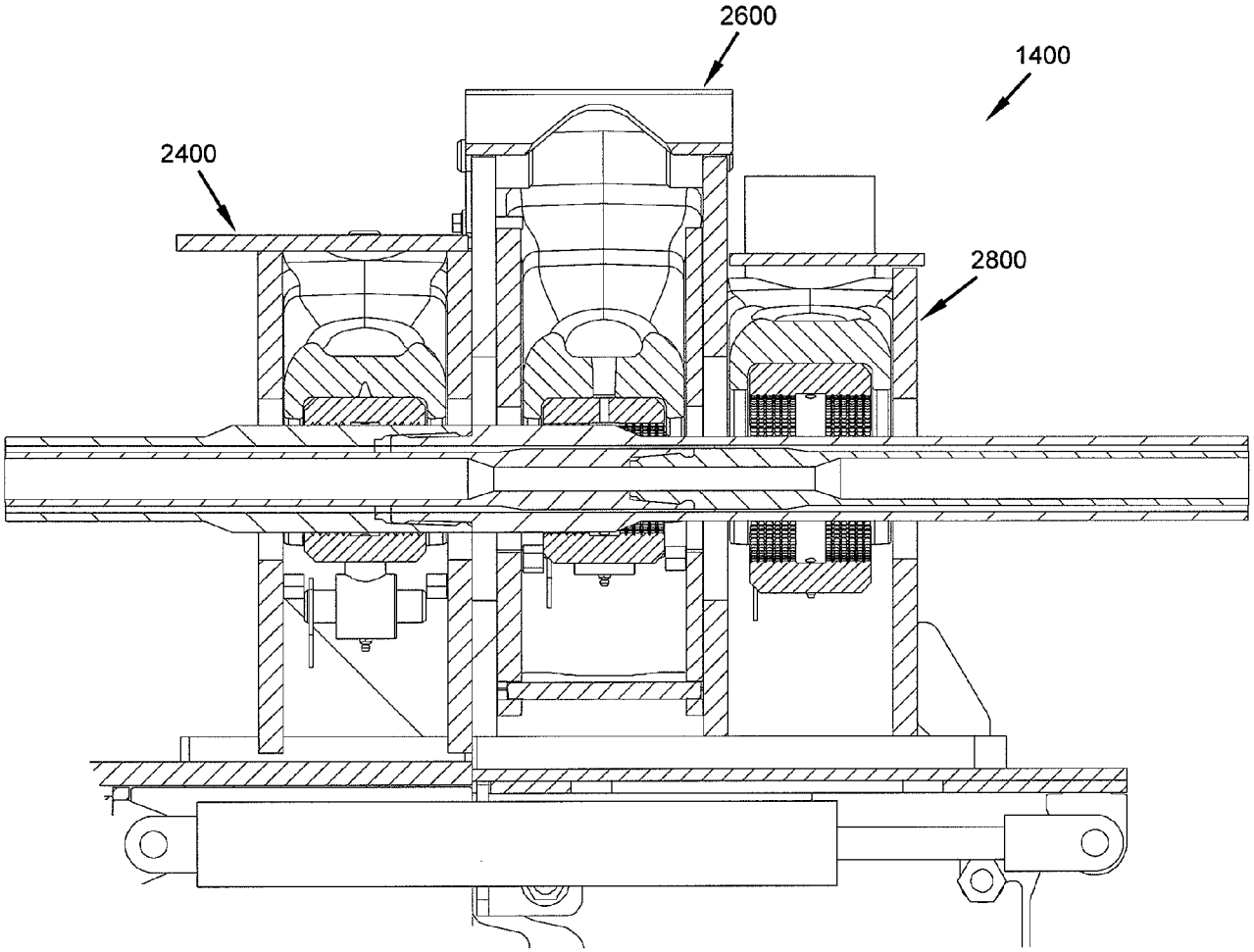
FIG. 7 is an exploded view of the break out mechanism shown in FIG. 5.
Figure 8:
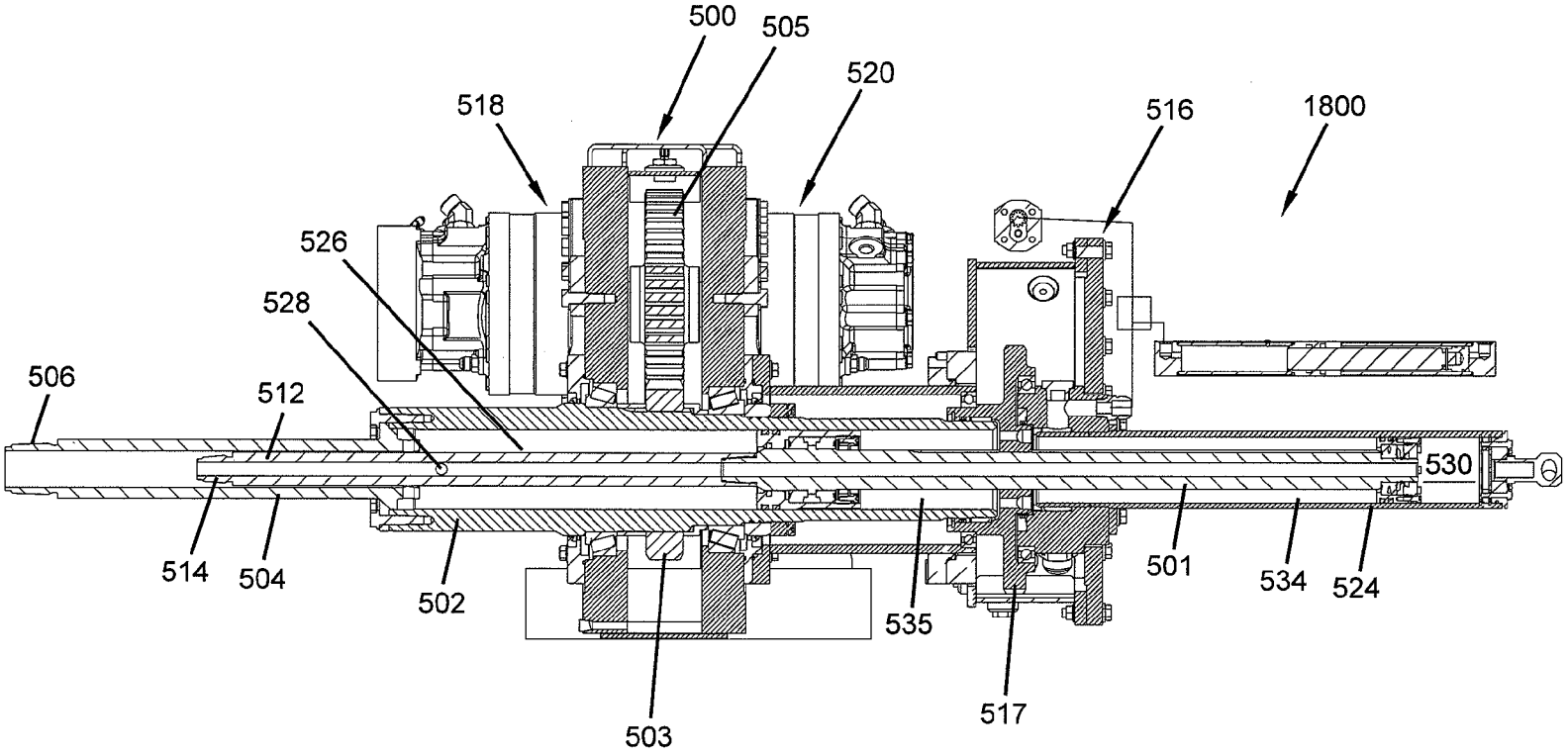
FIG. 8 is an enlarged cross-sectional view of the drive unit as shown in FIG. 5, with the inner rod driver extended.
Figure 9:
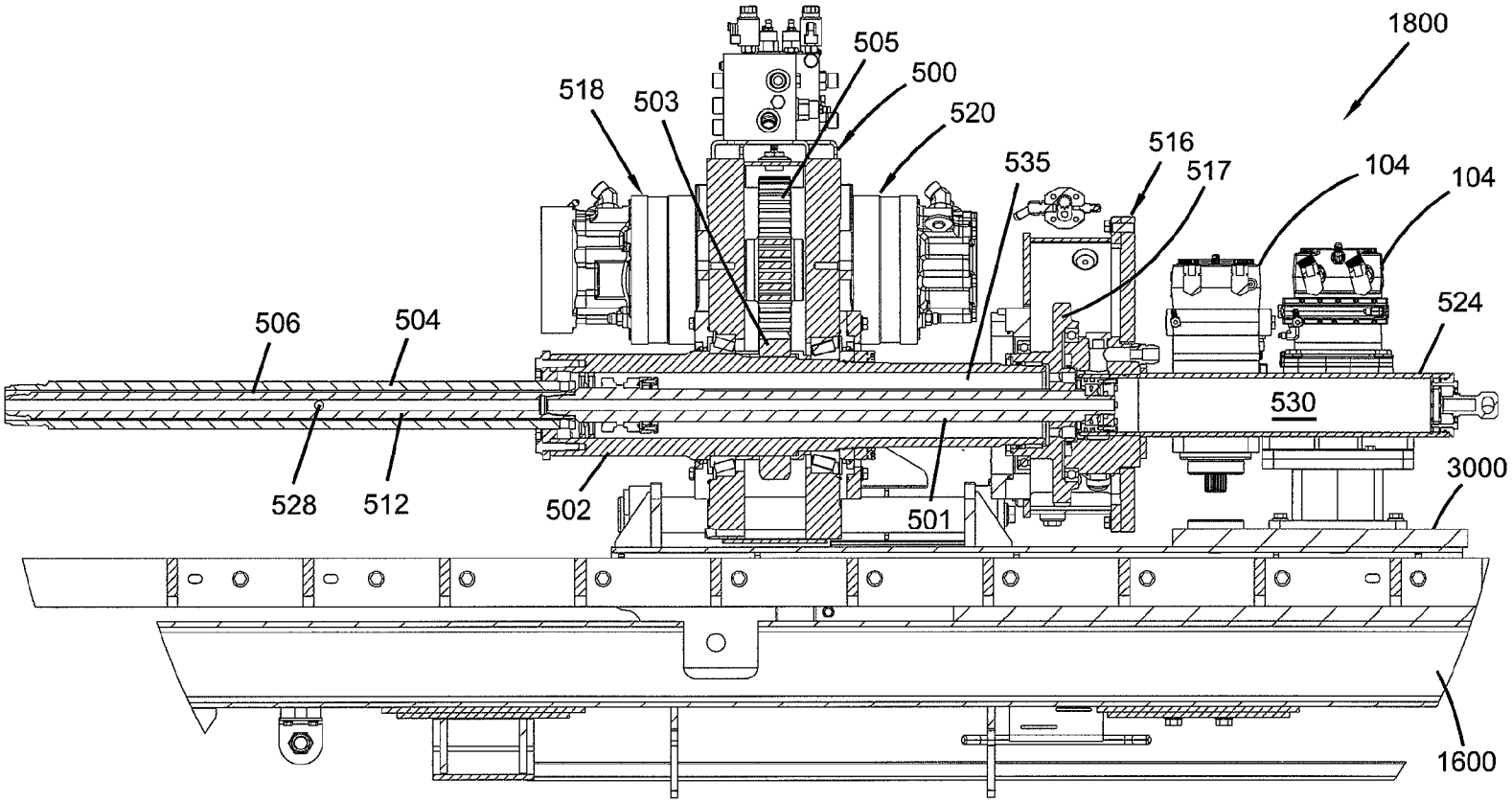
FIG. 9 is an enlarged cross-sectional view of the drive unit similar to FIG. 8, with the inner rod driver extended.

The drill rod drive unit 1800 of the present invention is illustrated in more detail in FIGS. 5, 8 and 9, with an inner drive assembly 3200 configured to provide rotational torque to rotationally drive an inner rod, an outer drive assembly 3400 configured to provide rotational torque to an outer rod drive spindle 506 configured to rotationally drive an outer rod, and carriage 3000 configured to drive both longitudinally.

The drive unit 1800 includes an outer rod driver gearbox 500 that supports two hydraulic motors 518 and 520, outer rod drive shaft 504, head shaft 502 and a set of gears 505 and 503. These components are configured to provide rotational drive torque to the outer rod drive spindle 506 through an arrangement that includes the head shaft 502 that is connected to an adapter 504 and includes the outer rod drive spindle 506 that is configured to thread onto the end of an outer member of a drill rod of a drill string.

Figure 10:
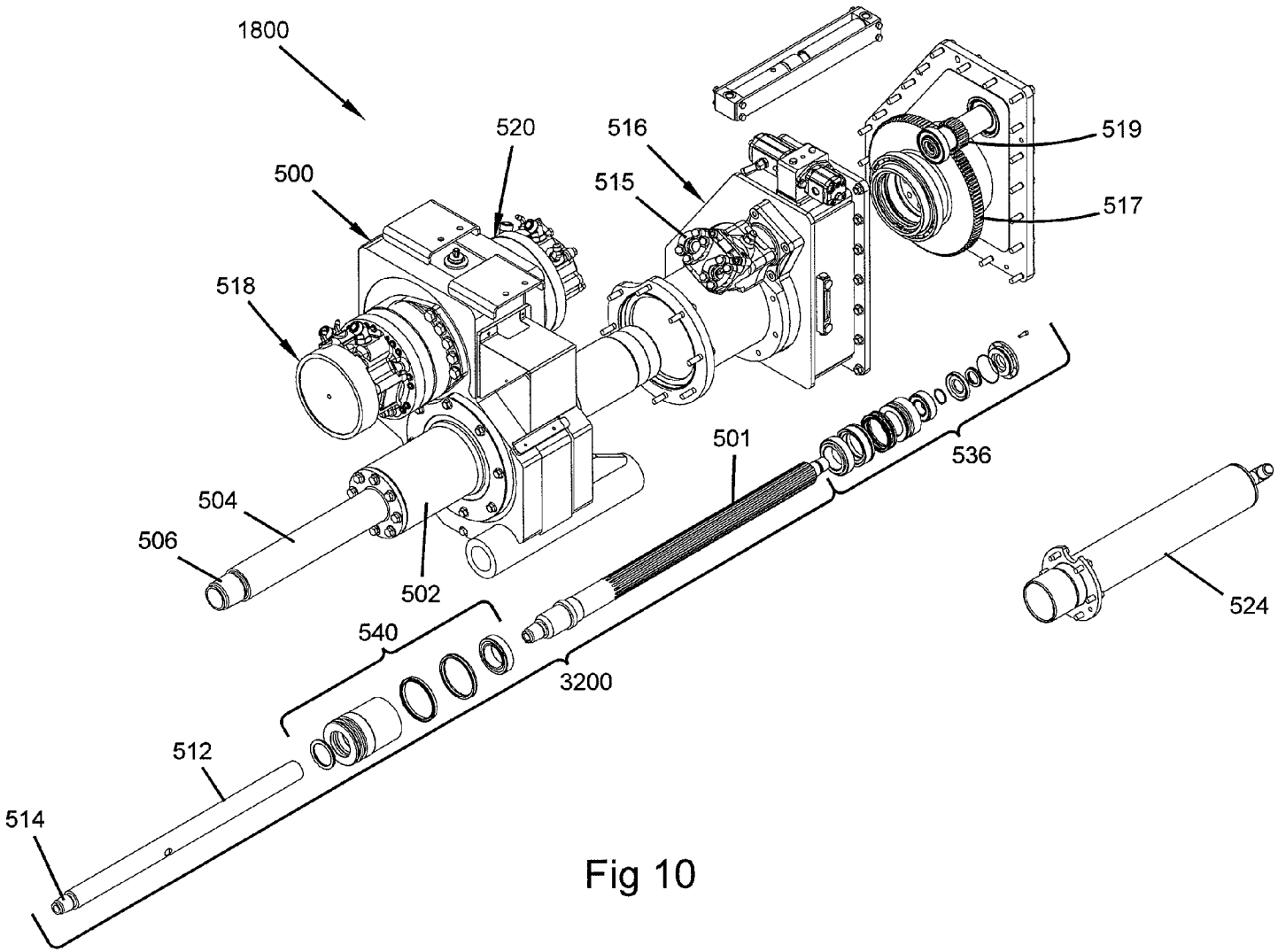
FIG. 10 is an exploded view of the drill rod drive unit shown in FIGS. 8 and 9.

The drill rod drive unit 1800 further includes an inner rod driver gearbox 516 that supports a hydraulic motor 515 that is shown in FIG. 10. Cross-sectional views FIGS. 5, 8 and 9 illustrate gear 517 that meshes with a gear 519, that is driven by motor 515, to provide rotational torque to gear 517 that is coupled to hollow splined shaft 501 that can slide in a longitudinal direction relative to the outer drill rod drive assembly 3400. The hollow splined shaft 501 (also referred to herein as a compensator shaft) is connected to a hollow inner rod adapter 512. The inner rod adapter 512 includes an inner rod drive spindle 514 at its distal end that is configured to thread onto the end of an inner rod of a drill rod of a drill string. In the depicted embodiment the rotation of the splined shaft 501 is driven by an inner rod driving gear box 516. In the depicted embodiment the hollow splined shaft 501 is housed partially within the head shaft 502, which is configured to rotate, and a piston tube 524. Drilling mud is supplied to the rear space 530 of the piston tube 524 and delivered to the drill string through the center aperture splined shaft 501 and the inner rod adapter 512. In addition, the mud is allowed to flow out of an aperture 528 of the inner rod adapter 512 into space 526 between the external surface of the inner rod adapter 512 and the internal surface of the head shaft 502.

In the depicted embodiment the space 534 between the external surface of the splined shaft 501 and the internal surface of the piston tube 524, and the space 535 between the external surface of the splined shaft 501 and the internal surface of the head shaft 502 houses lubricating oil. The lubricating oil lubricates the connection between the splined shaft 501 and the gear box 516. A first seal and bearing assembly 536 is provided at the proximal end 538 of the splined shaft 501. The first seal and bearing assembly 536 is configured to prevent mud from entering space 530 and contaminating the lubricating oil therein. The first seal and bearing assembly 536 is configured to allow the splined shaft 501 to rotate relative to the piston tube 524. A second seal and bearing assembly 540 is provided at the distal end of the splined shaft 501. The second seal and bearing assembly 540 is configured to prevent mud from entering space 535 and contaminating the lubricating oil therein. The second seal and bearing assembly 540 is configured to allow the splined shaft 501 to rotate relative to the head shaft 502. The lateral position of the splined shaft 501 (the degree to which the splined shaft 501 is extended) can be controlled by increasing (or decreasing) the volume of oil within spaces 534 or 535. In the depicted embodiment, the splined shaft 501 is extended by increasing the oil volume with desired pressure and retracted by mechanical engagement with the drill rods of the drill string. In the depicted embodiment, the spaces 534 and 535 are in fluid communication with each other; therefore, the hydraulic pressures in both spaces are the same.

Figure 11:
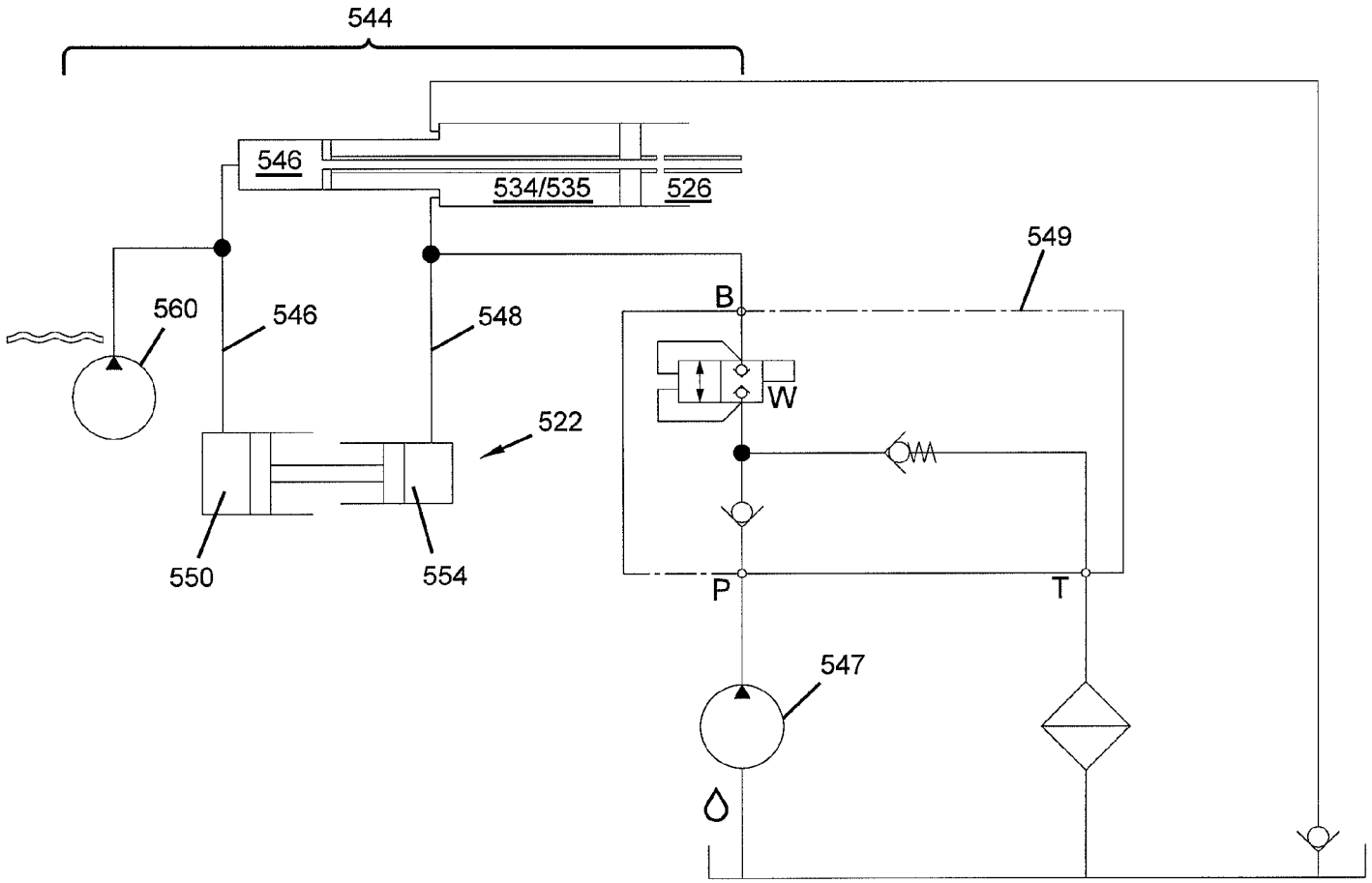
FIG. 11 is a portion of a hydraulic circuit of the drill string drive assembly.

Referring to FIG. 11, a portion of the hydraulic circuit for the compensator assembly 3600 is shown. The hydraulic circuit is configured to prevent contamination of the hydraulic system that would result if mud in spaces 530 or 526 leaked past the first or second seal and bearing assemblies 536, 540 into spaces 526 or 535. To prevent this contamination, the system is designed so that the oil pressure is slightly greater than the mud pressure. In operation the pressure in the mud can change very unpredictably and quickly. The present system provides a configuration that maintains the hydraulic pressure in spaces 534 and 535 at a level greater than the mud pressure, even when the mud pressure spikes abruptly.

In the depicted embodiment the contamination prevention system is passive in that it does not rely on an active control system (e.g., measuring the pressure in the mud and controlling valves or pumps to maintain a certain pressure differential). In the depicted embodiment, the system is instantaneous in that an increase in mud pressure causes a direct increase in hydraulic fluid pressure. In the depicted embodiment a pressure intensifier assembly 544 includes a first line 546 in fluid communication with the space 526 that contains mud, and a second line 548 in fluid communication with space 534/535 that contains hydraulic fluid. In the depicted embodiment the second line 548 is in fluid communication with a control valve 549 and a pump 547 that is used to increase or decrease the volume of oil in the space 534/535 to extend or retract the inner drive assembly 3200 relative to the outer drive assembly during the process of building a drill string or breaking down a drill string. In the depicted embodiment, the passive pressure intensifier assembly 544 is configured to function regardless of whether this active fluid control component is shut off as during typically drilling (e.g., thrusting and rotating of the drill rod), or turned on as when extending or retracting the inner rod drive assembly 3200 during make up and break up of a drill string.

The first line 546 is directed to a first portion 550 of cylinder assembly 522 with a piston face having a first area and the second line 548 is directed to a second portion 554 of the cylinder assembly 522 having a second area. The first line 546 is also in fluid communication with a mud pump, which supplies mud to the drill string via spaces 530 and 526. The first area 550 is greater than the second area 554, which results in a greater pressure in the second portion 554 than the first portion 550. The ratio of the first area to the second area of the piston is proportional to the difference in pressure between the two portions of the cylinder assembly 522. Accordingly, a pressure increase (spike) in the mud in spaces 530 and 526 will result in a corresponding hydraulic pressure increase (spike) in the space 534/535. Example piston dimensions are identified in FIG. 11.

As a result of the configuration of the drill rod drive unit 1800 described above, the inner rod driver 514 can move longitudinally while the outer rod driver 506 can be in a fixed position, relative to the carriage 3000. The distance that the inner rod driver 514 can move is determined by the length of the hollow splined shaft 501 and head shaft 502, and is thus a design choice. With this configuration that distance can conveniently be in excess of twelve inches. The illustrated configuration of the present invention provides a compact arrangement, with this distance set to be approximately twenty four inches. In other embodiments, by modification of these components, it would be possible to design this distance to be a minimum of four inches, or anything more than four inches (e.g., twelve inches).

Figure 2:
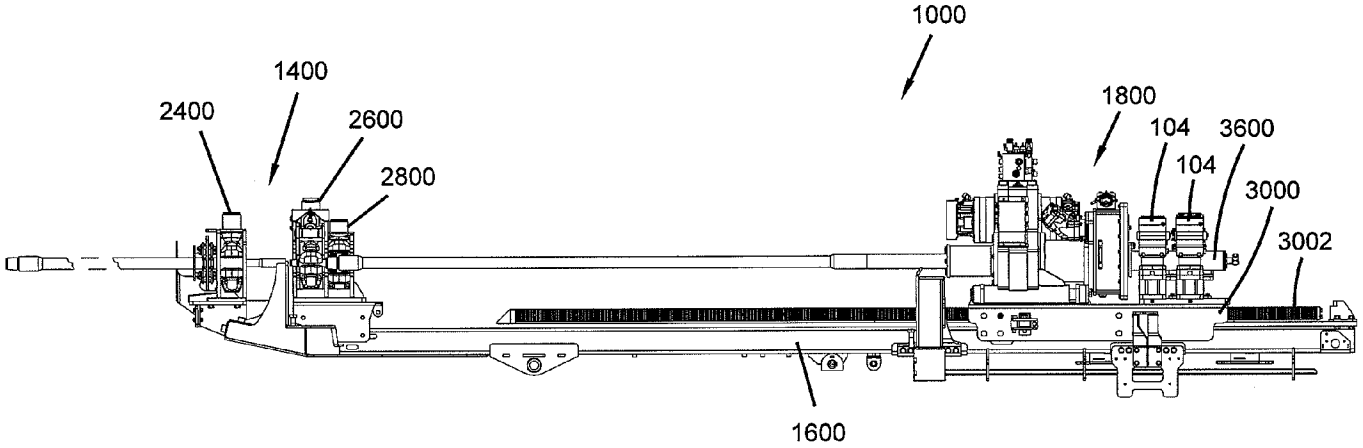
FIG. 2 is a side view of a drill string drive assembly of a drilling machine similar to the machine of FIG. 1 with a drive assembly of the present invention on one end, and a break out mechanism of the present invention, with a pair of vises set in a position longitudinally spaced from a single bottom vise, on the other end.
Figure 3:
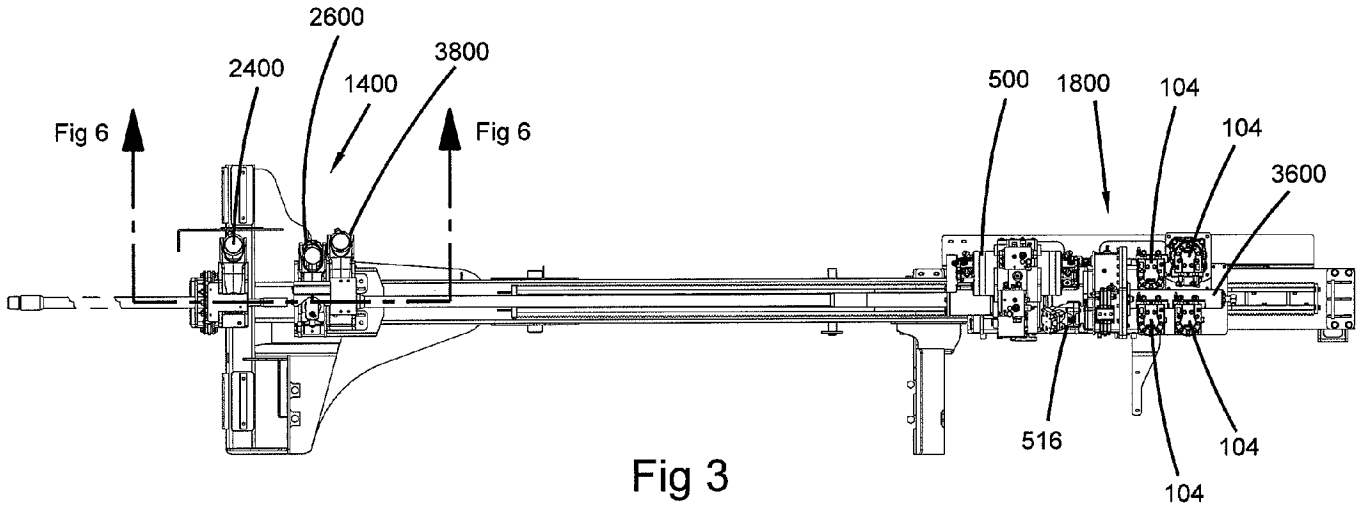
FIG. 3 is a top view of FIG. 2.
Figure 4:
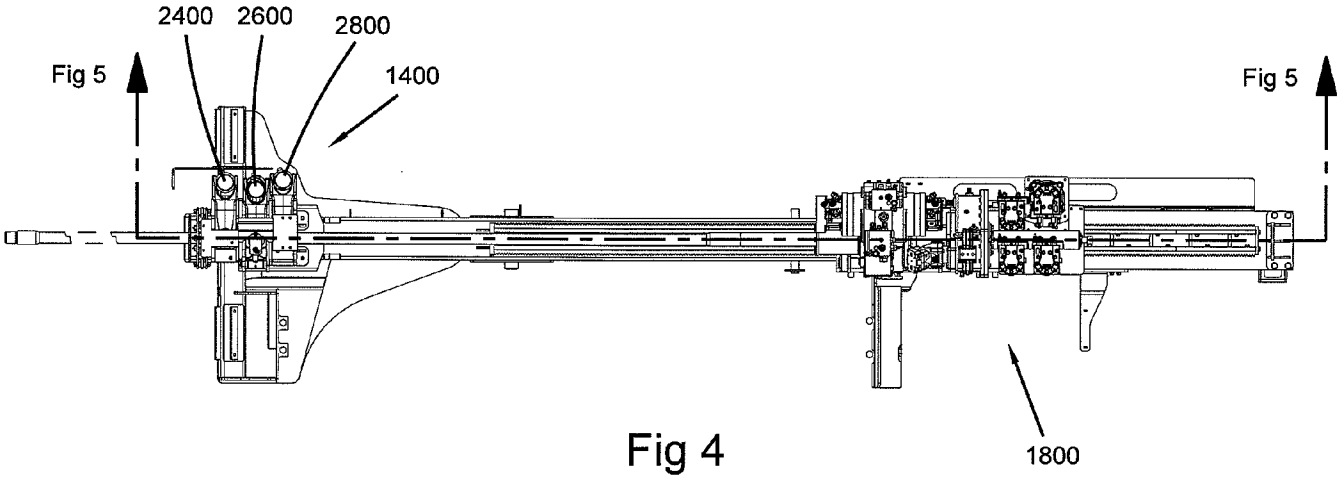
FIG. 4 is a top view similar to FIG. 3 with a break out mechanism of the present invention, with a pair of vises set in a position adjacent to a single bottom vise.

As illustrated in FIG. 2, the drill rod drive unit is mounted to carriage 3000 which is configured to be moved along the rack 1600. It should be understood that there are many alternative methods to move a carriage along a rack. The illustrated system includes hydraulic motors 104 that power pinion gears that are engaged with a rack gear 3002. Rotation of the pinion gears causes the carriage to move along the rack in either direction, to move the drill rod longitudinally, while the outer drive assembly 3400 is capable of independently rotating the outer rod drive spindle 506 and the inner rod drive assembly 3200 is capable of independently rotating the inner rod drive spindle 514. In addition, as described in the previous description, the drive assembly provides a method of controlling relative longitudinal position and movement of the outer rod drive spindle 506 compared to the inner rod drive spindle 514. The carriage assembly is additionally configured to allow a small amount of relative movement between the carriage and the outer drive assembly. The illustrated embodiment includes slide rods that provide a freedom of movement so that the outer drive assembly and inner drive assemblies can move longitudinally during the threading operation wherein movement of the entire carriage is not required. With this described capability, the driving mechanism is configured to be connected to a dual rod drill sting that connects to drill head 160 illustrated in FIGS. 12 and 13 as will be described in more detail below.

Figure 12:
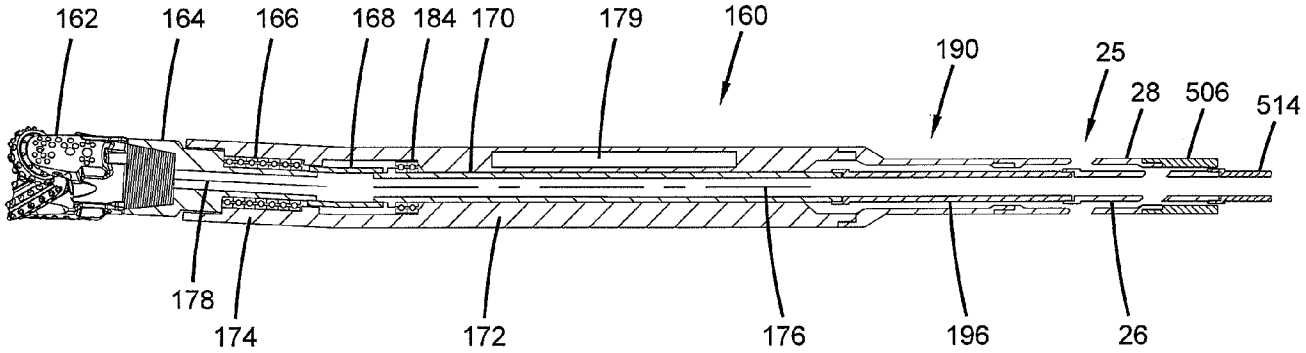
FIG. 12 is a cross-section of a drill head connected to the drill string drivers of the present invention.
Figure 13:
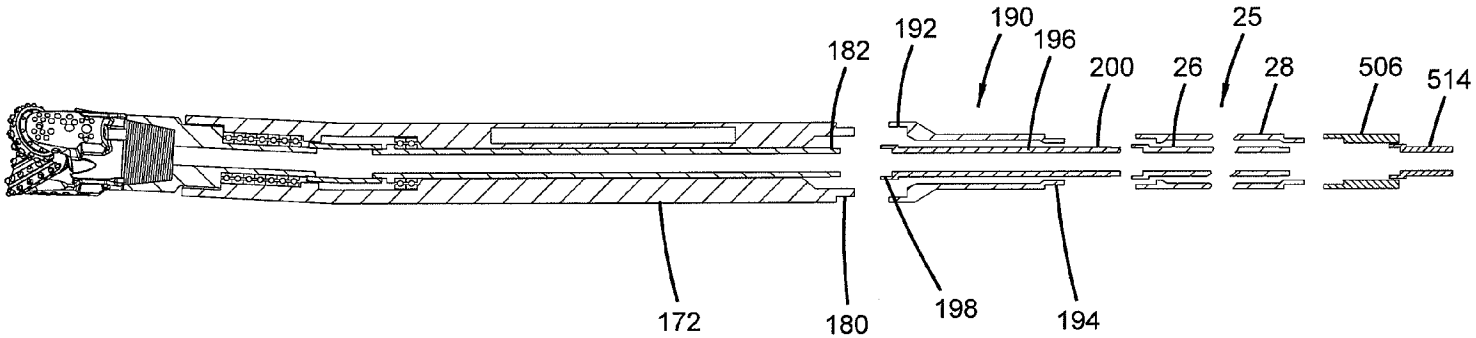
FIG. 13 is a cross-section of the drill head in an exploded arrangement.

Drill head 160 of FIGS. 12 and 13 is similar to the drill head illustrated as item 112 in FIG. 1, including a cutting structure 162, that is illustrated as a tri-cone roller bit. The bit 162 is connected to a bit adaptor 162 that is supported by bearings 166 within housing 172. The housing 172 includes an offset bent section wherein the axis 178 of the bearing mount bore 174 is angularly offset from the main axis of the body 176, in a configuration that is known as a bent sub. The bit adaptor is also connected to a transmission element 168, that transfers rotational torque from the inner drive shaft 170, to the bit adaptor 164. With this configuration the drill bit is positioned by the main body, while being rotated by the inner drive shaft.

The drill head further includes a cavity 179 configured for carrying a sonde which is a component that can communicate information about the position and orientation of the housing 172 to the surface. The housing 172 is configured to be connected to an adaptor 190. The illustrated embodiment includes the housing having a threaded end 180 configured to fit into a threaded end 192 of the adaptor. The opposite end of the adaptor 190 is configured to be connected to the outer rod 28. The illustrated embodiment includes the adaptor having a male threaded end 194, commonly known as a pin, with the outer rod 28 having a female threaded end, known as a box. The adaptor could be configured with a box on end 194, wherein the drill rod 28 would need to have a pin on the mating end. The opposite side of the rod 28 is configured to be connected to outer rod drive spindle 506. The illustrated example shows the down-hole end of the outer rod having a box, and the up-hole end of the outer rod having a pin, with the outer rod drive spindle having a box. It should be appreciated that the box/pin arrangement could be reversed, the drive spindle could alternately be a pin, with all the following connections also reversed. With either configuration, the housing 172 of the drill head 160 is directly connected to the outer rod drive spindle 506. As a result, the orientation of the bent sub, that is part of the housing 172, is controlled by rotating the outer rod drive spindle 506. This capability is used to control the direction of the advancement of the bore. The force required to move the drill bit, often referred to as weight on bit, can be transferred through the outer drill rod, through bearings 166, to the bit adaptor 164. In this manner the outer rod is capable of controlling the position of the drill head, both its rotational position, and its longitudinal position.

The rotation of the drill bit 162 is provided by the inner rod, with torque being transferred through the transmission 168, which is connected on one end to the bit adaptor and on the opposite end to the inner drive shaft 170 of the drill head. The opposite end of the inner drive shaft 182 is configured to be connected to the inner drive member 196 of the adaptor 190. Connection between the inner drive shaft 170 of the drill head and the adaptor 190 occurs when the end 182 is coupled to end 198. This connection can be configured in at least two optional ways including: a rigid connection such as if both ends are threaded for mating connection, or a non-rigid connection where the ends are in sliding engagement, such as if the end 182 had a hexagonal outer profile, and end 198 had an aperture with a hexagonal inner profile so that the connection would transfer torque, but would not transfer longitudinal forces. These two optional configurations affect the configuration of other components of the machine, as will be described in more detail later.

In either configuration the opposite end 200 of the inner drive member 196 is configured to be in a threaded connection with an inner rod. The illustrated configuration includes the end 200 configured as a pin-end, with the mating end of inner rod 26 being configured as a box-end. As noted above in the explanation of the outer rod, this pin/box arrangement can be interchanged, and either arrangement can work. Once all connections are made, the inner rod driver 514 will be connected to transfer rotational power to the drill bit. The affect of longitudinal movement of the inner rod driver 514 relative the outer rod driver 506 will be affected by the design choice of the connection between ends 182 and 198. If this connection is rigid, then once all the rod connections are made, there can be no relative movement between the inner rod driver 514 and the outer rod driver 506, and the relative position of these two drivers will be affected by the cumulative length of the inner rods and the outer rods. Since both the inner rods and the outer rods have some inherent variation of length, the relative position of the inner rod driver 514 and the outer rod driver 506 needs to be adjustable in order to compensate for the difference in the length of the inner drill string compared to the outer drill string. This difference can be significant, as an example, with a 500 foot drill string made of 10 foot long drill rods, and with potential difference in length of ¼ inch per drill rod, the difference in length between the inner and outer drill string can be in excess of 10 inches. The capability to compensate for this difference in length is provided by the drill rod drive unit of the present invention as described earlier.

Figure 16A:
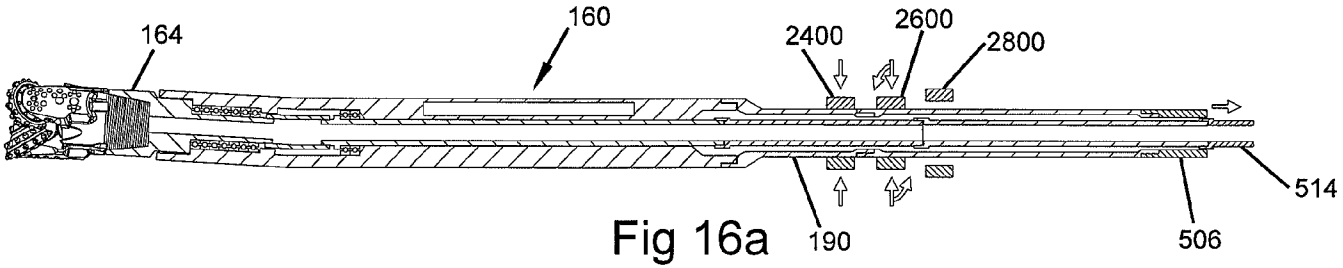
FIGS. 16*a*-16*n* illustrate the sequence of operations to remove a drill rod with a drill head of a first configuration.
Figure 16B:
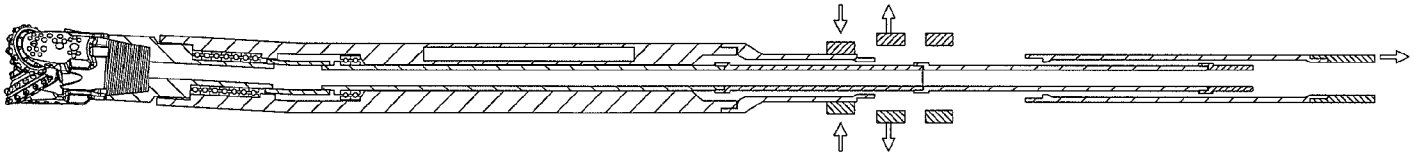
Figure 16C:
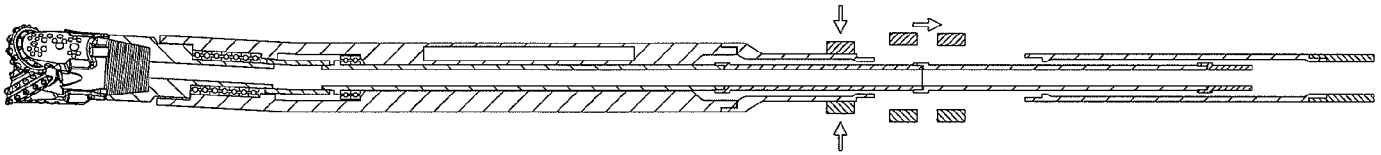
Figure 16D:
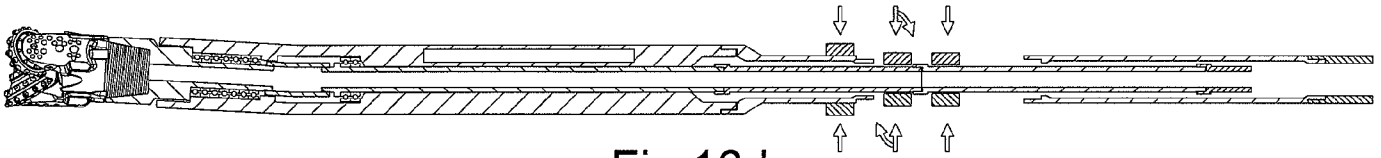
Figure 16E:
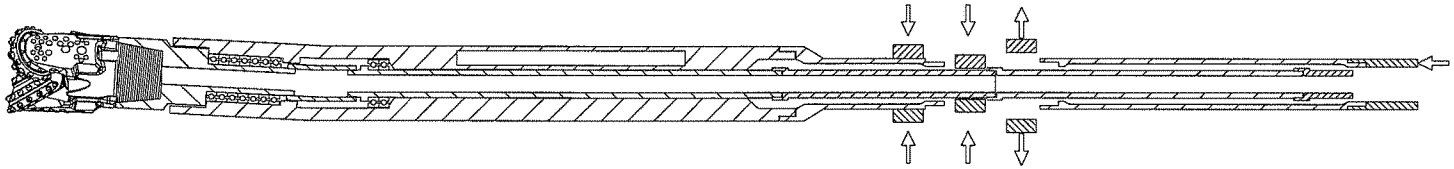
Figure 16F:
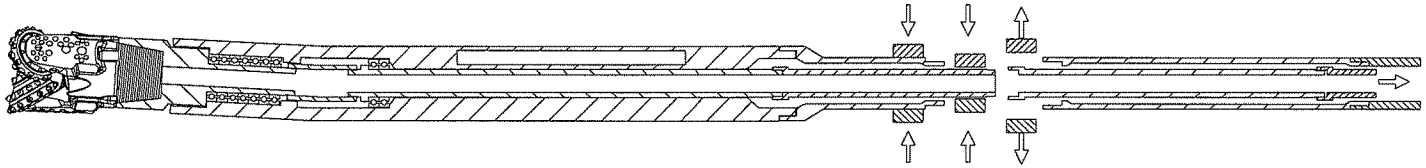
Figure 16G:
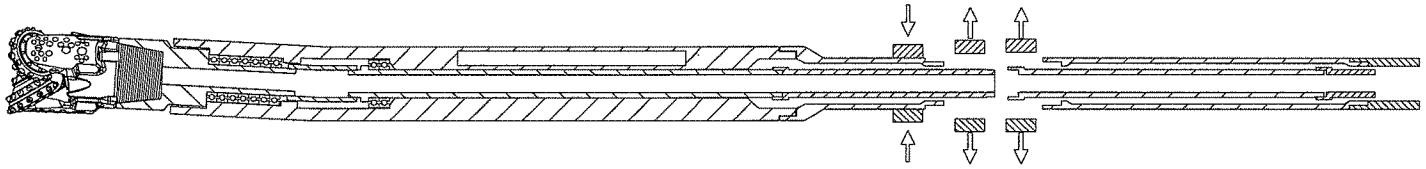
Figure 16H:
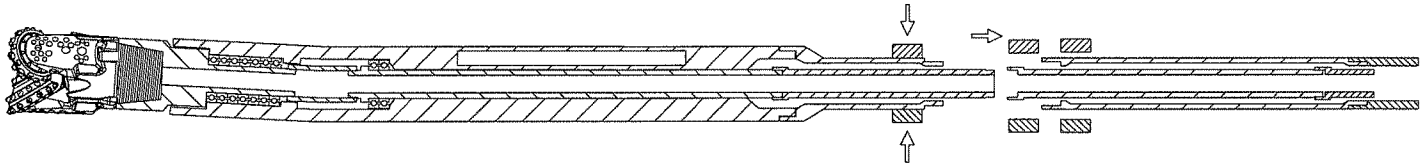
Figure 16I:
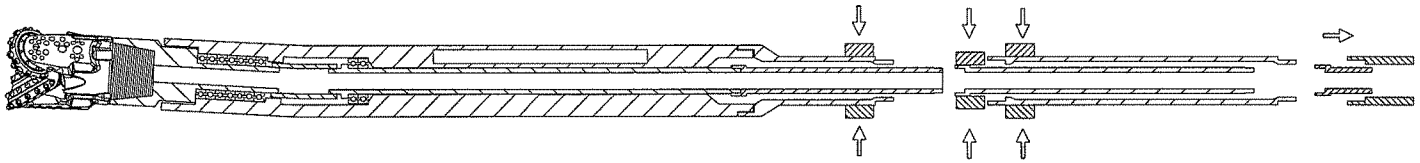
Figure 16J:
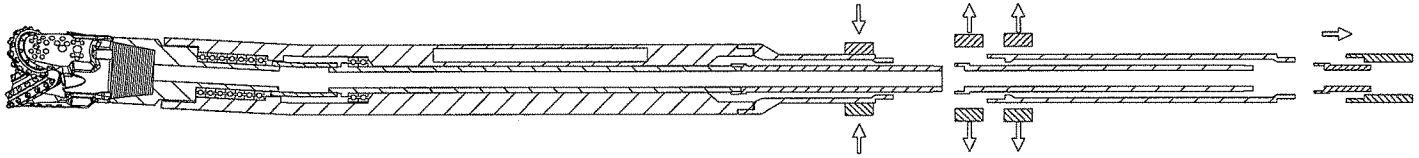
Figure 16K:
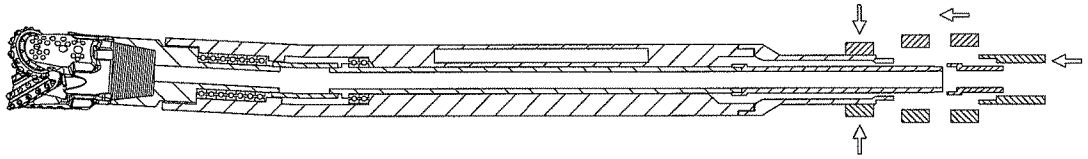
Figure 16L:
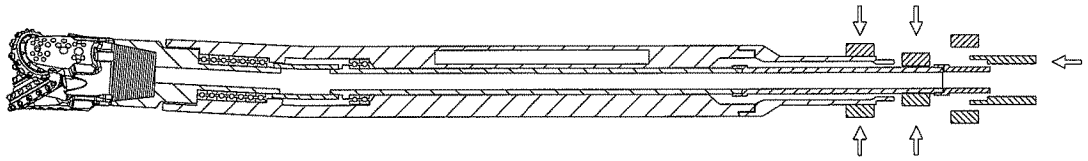
Figure 16M:
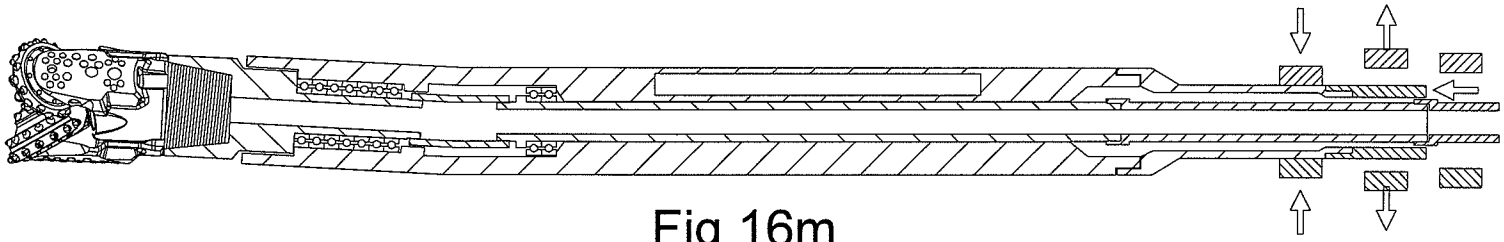
Figure 16N:
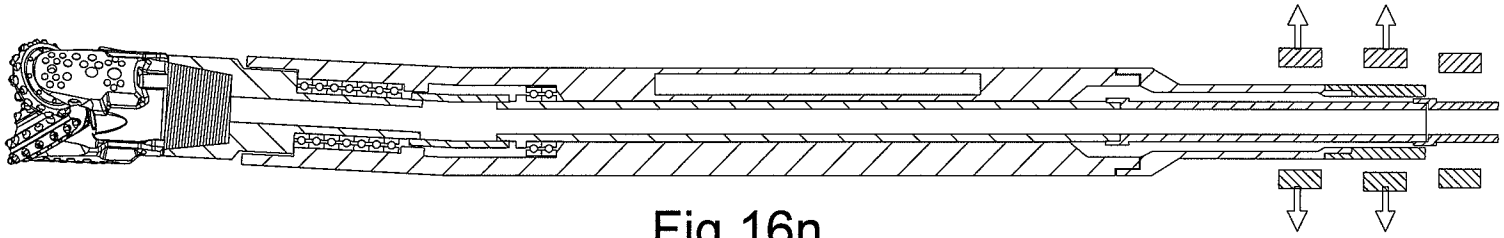
Figure 17A:
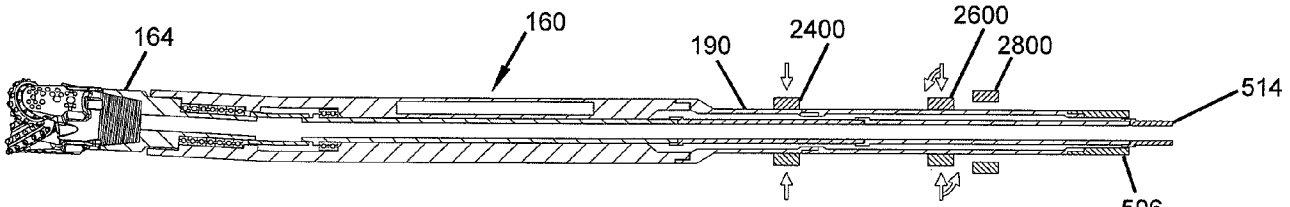
FIGS. 17*a*-17*n* illustrate the sequence of operations to remove a drill rod with a drill head of a second configuration.
Figure 17B:
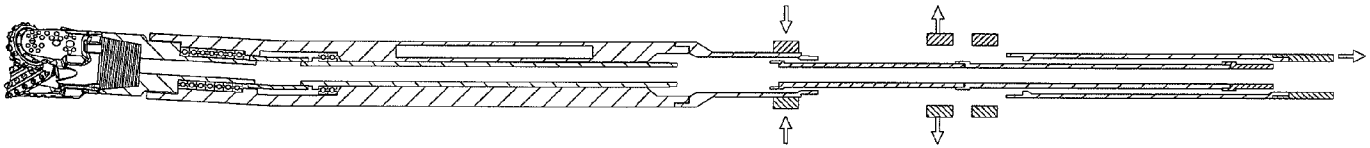
Figure 17C:
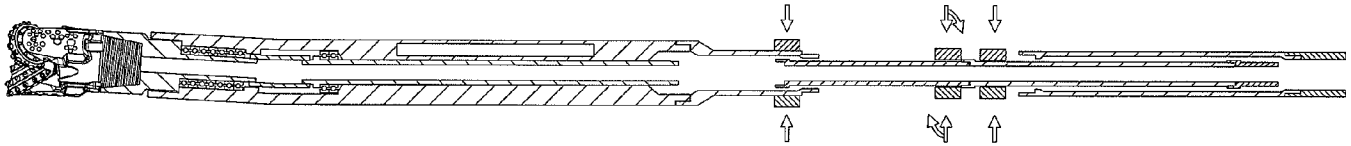
Figure 17D:
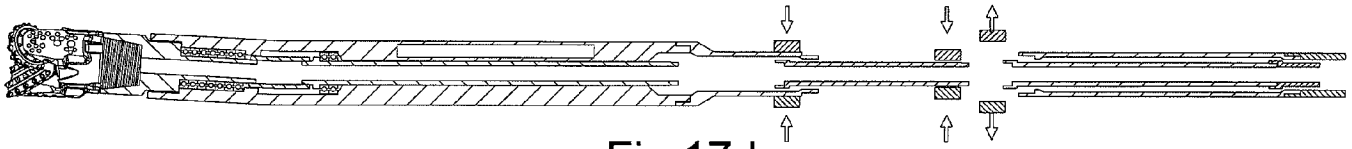
Figure 17E:
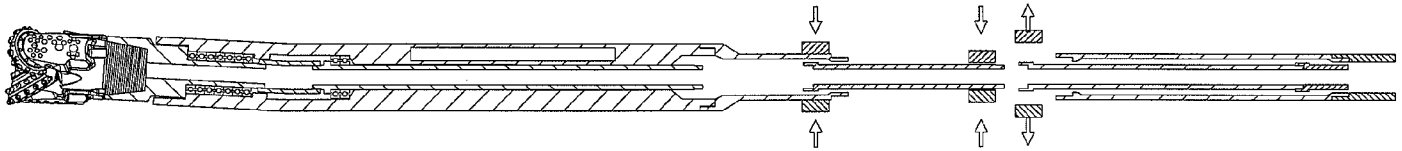
Figure 17F:
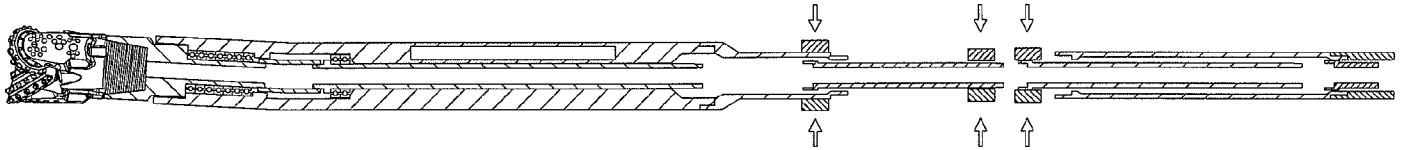
Figure 17G:
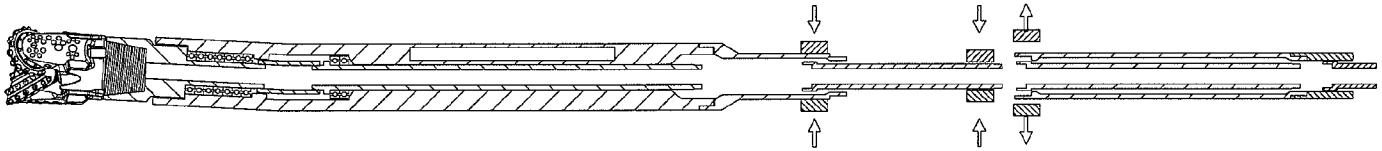
Figure 17H:
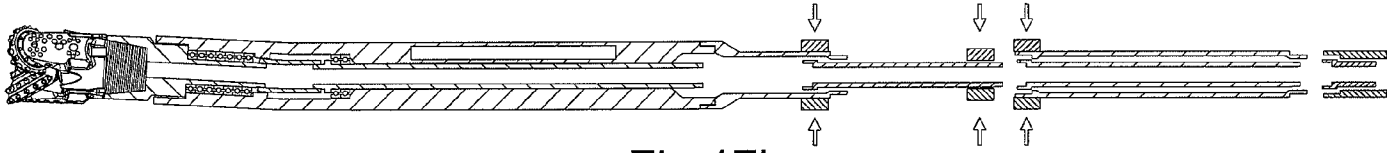
Figure 17I:
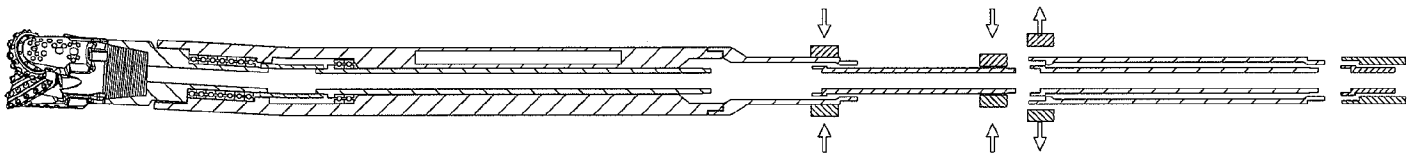
Figure 17J:
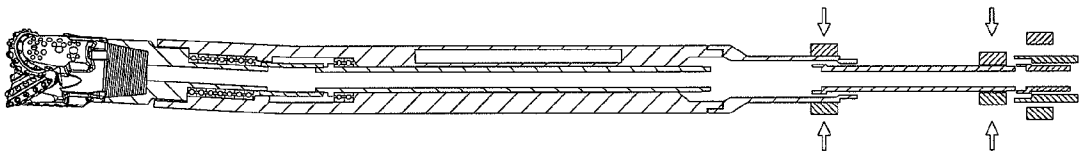
Figure 17K:
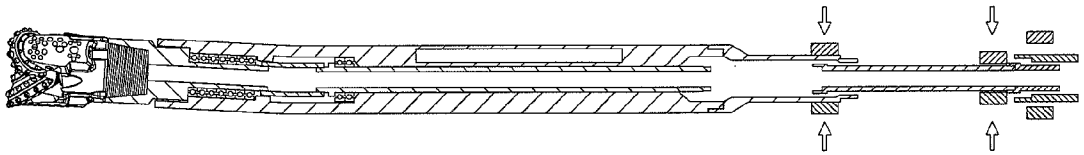
Figure 17L:
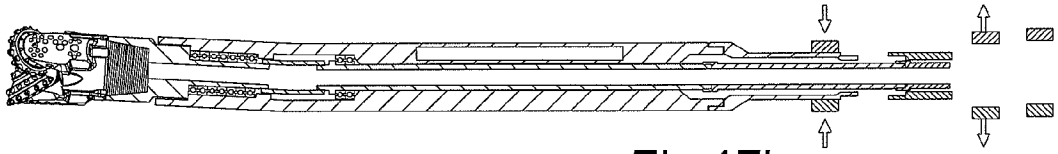
Figure 17M:
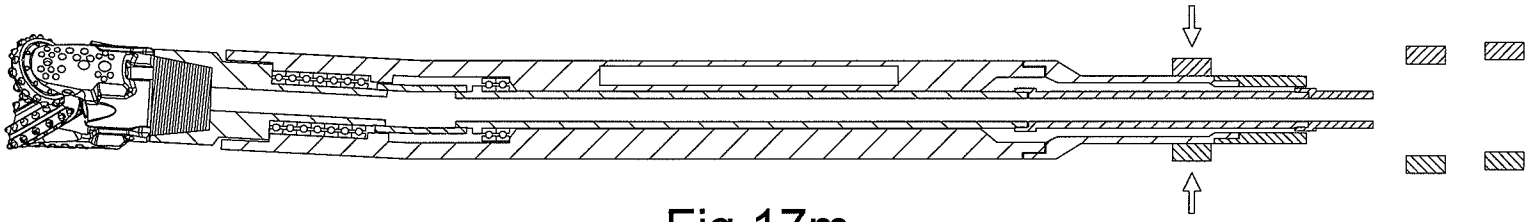
Figure 17N:
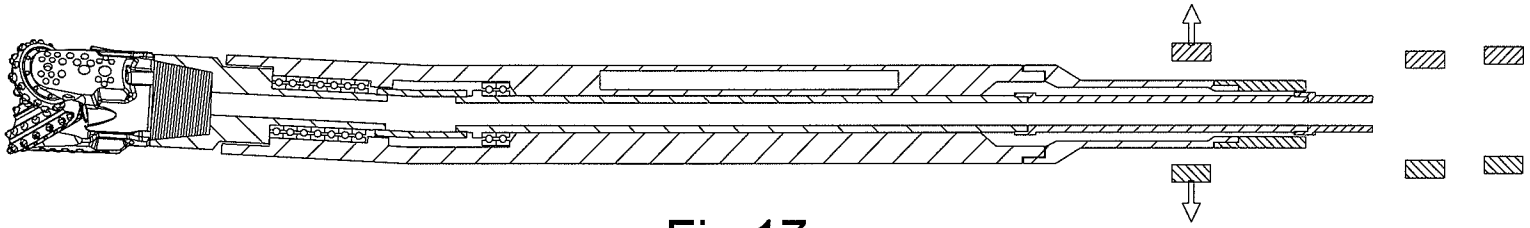

In addition to providing compensation for an accumulation of differences in length, the ability of the drill rod drive unit to allow the inner rod driver to move relative to the outer rod driver, of the present invention, is also required to enable the vises to grip the inner drill rod during make-up and break-out functions. To highlight the flexibility of the drill system there are four different combinations illustrated:

a) FIGS. 14*a* through 14*k* illustrate a sequence of movements of the vise assembly of the present invention, as coordinated with movements of the inner and outer rod drivers for adding a drill rod in a make-up sequence with the inner rod rigidly connected to the inner drive shaft of the drill head;

b) FIGS. 15*a* through 15*j* illustrate a sequence of movements of the vise assembly of the present invention, as coordinated with movements of the inner and outer rod drivers for adding a drill rod in a make-up sequence with the inner rod non-rigidly connected to the inner drive shaft of the drill head.

c) FIGS. 16*a* through 16*n* illustrate a sequence of movements of the vise assembly of the present invention, as coordinated with movements of the inner and outer rod drivers for removing a drill rod in a break-out sequence with the inner rod rigidly connected to the inner drive shaft of the drill head;

d) FIGS. 17*a* through 17*n* illustrate a sequence of movements of the vise assembly of the present invention, as coordinated with movements of the inner and outer rod drivers for removing a drill rod in a break-out sequence with the inner rod non-rigidly connected to the inner drive shaft of the drill head.

Figure 14A:
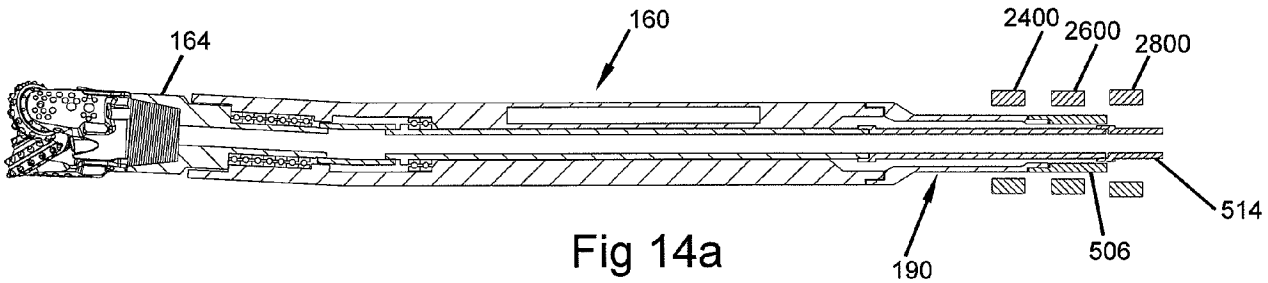
FIGS. 14*a*-14*k* illustrate the sequence of operations to add a drill rod with a drill head of a first configuration
Figure 14B:
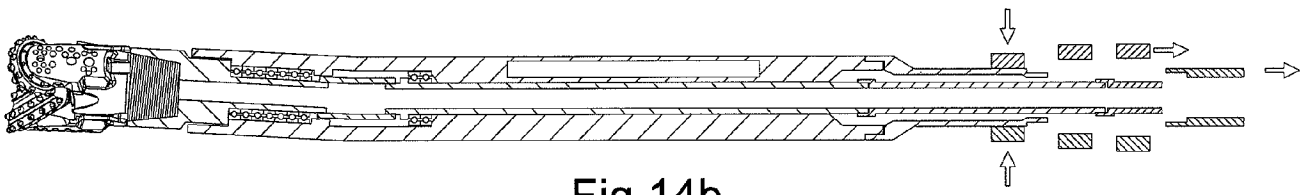

The sequence illustrated in FIGS. 14*a*-14*k* starts with the rod drivers 514 and 506 connected to a first drill string member, and positioned at the end of travel along the rack. FIG. 14*a* illustrates the drivers connected to a drill string that comprises only the adaptor 190 and the drill head 160. In this position the drivers will more often be connected to drill rod 25, but the function of the vises and driver are the same in either case. The process starts when the joint between the outer drive spindle and the drill string is located adjacent the lower vise 2400 as illustrated in FIG. 14*a*. Once in that position the lower vise is clamped onto the outer rod of the drill string, as illustrated in FIG. 14*b* the drill string comprises only the adaptor and the drill head. The proper positioning of the outer rod driver to initiate this first step of clamping can be accomplished either manually, where an operator observes the process and directly operates the controls, or automatically, where a control system is configured to monitor signals from position sensors and to adjust control signals to the machine systems to control the process independent of operator input. After the drill string is clamped by the lower vise 2400, the outer rod driver 506 is rotated and pulled-back as shown in FIG. 14*b*, to expose the inner rod, and to a position where the outer rod can be lubricated. The middle vise 2600 and upper vise 2800 then are repositioned to align with the joint in the inner rod. A system that provides that capability of position the vise is the proper location to accomplish the above steps is illustrated in FIGS. 18*a* and 18*b*.

Figure 18A:
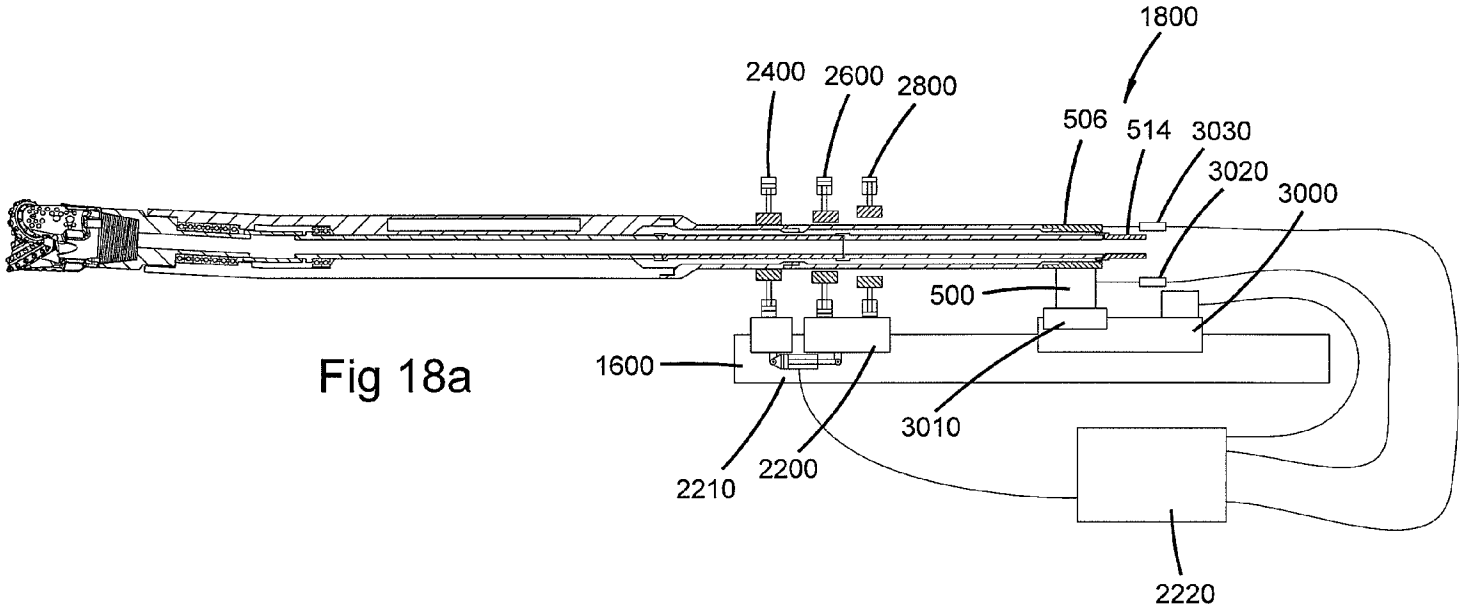
FIGS. 18*a* and 18*b* illustrate a control system
Figure 18B:
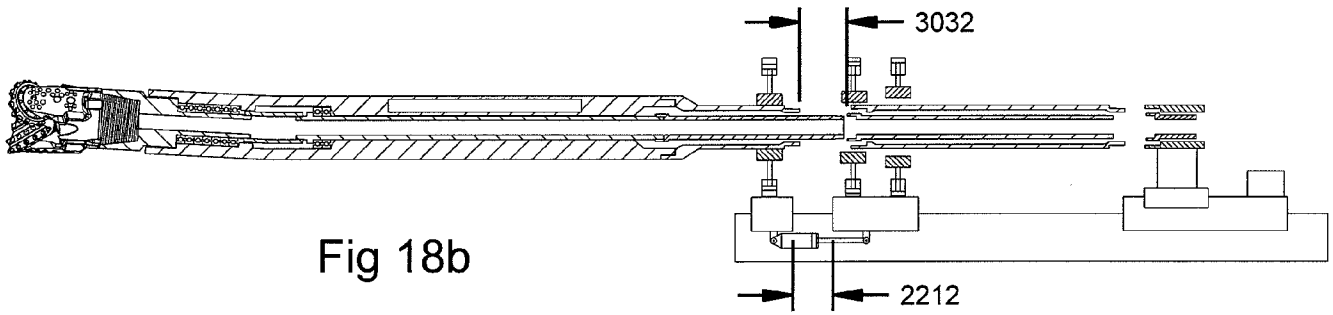

FIG. 18*a* illustrates elements of the system including the front vise 2400 which is fixed to the rack 1600. Vises 2600 and 2800 are mounted to a vise carriage 2200 that can move relative to the rack. Cylinder 2210 is utilized to position the vise carriage, and includes a transducer that is connected to a controller 2220 to monitor the position of vises 2600 and 2800. Controller 2220 is operatively connected to the system that controls extension and retraction of cylinder 2210, which can include a hydraulic system if the cylinder is in the form of a hydraulic cylinder, or an electrical system, if the cylinder is in the form of an electric linear actuator.

The system also includes the drill rod drive unit 1800 supported on carriage 3000 with the outer rod driver gearbox 500 supported on gearbox carriage 3010. The position of the carriage 3000, along the rack 1600, is measured by a rotary encoder, which is operatively connected to the controller 2220 to monitor the rotation of the pinion gear and constantly calculate the position of the carriage. As noted earlier, there are many ways to propel a carriage along a rack, with the pinion gear and rack gear being one example way. The use of a rotary encoder is likewise one option of several alternative methods of monitoring the position of the carriage. The key feature is that the transducer produces a signal that controller 2220 will monitor to determine the carriage position. Although not shown, the controller produces control signals for the system that controls the movement of the carriage.

In order to reliably control the process of making and breaking rods, the control system needs to be capable of determining the position of the outer rod driver, and of the inner rod driver. Since the inner rod driver can move relative to the outer rod driver, a first embodiment of the control system includes a transducer 3030 that provides a signal that controller 2220 can use to determine that relative position. Likewise, since the outer rod driver can move relative to the carriage, via movement of gearbox carriage 3010 relative to carriage 3000, the system includes a transducer 3020 that provides a signal that controller 2220 can use to determine that relative position. With information provided by these various transducers, controller 2220 is able to monitor the relative position of all the components, and implement the requisite control commands to reliably perform the predetermined sequence of steps.

An alternative embodiment of the control system does not include transducers 3030 or 3010, but substitutes control logic to position the inner rod driver at a known location relative to the outer rod driver and the gearbox carriage at a known location relative to the main carriage during specific stages of the process, and then uses the information generated by the rotary encoder to calculate the position of the rod drivers.

One of the stages in example process for use with a drill head with a fixed connection to the inner drill string that is worthy of particular note is the state illustrated in FIG. 18*b*. After the outer rod of the drill string is clamped by the lower vise 2400, and the outer rod of the rod being removed is unthreaded and pulled back to expose the inner rod, then the vise carriage needs to be positioned to properly align the vises with the joint of the inner rod. The position of this joint is affected by the length of the inner drill string, which will vary due to the variation of the length of the individual inner rods. The inner rod drill string can range from the illustrated example where there are no inner rods, where the drivers are connected to the adaptor, to situations where there could be 20 or more inner rods. Since the length of the inner rods can vary, often times by up to 0.25 inches per rod, the position of the inner rod joint could be several inches from a nominal position. In order to properly position the vise carriage, the control system will need to compensate for this variation.

One method of compensation is for the controller 2220 to monitor the output of transducer 3030 when the drill rod drive unit 1800 is properly connected to the drill string. In that configuration, the location of the inner rod driver 514 relative to the outer rod driver 506 can be measured, and used to determine a compensation factor. This can be illustrated by considering that there will be a nominal rod offset illustrated as dimension 3032 in FIG. 18*b*. With the inner drill string and outer drill string in nominal condition, there will be a known offset between the inner driver and the outer driver, the output of the transducer 3030 will be known. If the output of the transducer 3030 indicates that this offset is less than nominal when the drill rod drive unit is connected to the drill string, then the inner rod is shorter than nominal by the difference. In that situation, it is possible to determine the appropriate position of the vise carriage for the subsequent vise operation. Thus, the process is to measure the offset between the inner rod driver and the outer rod driver for each connection, and to use that offset information to calculate the appropriate position of the vise carriage for the subsequent break-out sequence.

An alternate method is to position the inner rod driver at a position where it is fully extended relative to the outer rod driver when the inner rod driver is threaded to inner drill string, when the gearbox carriage at its lower position. When in this configuration, the position of the carriage, as measured by the encoder, can be used to determine the relative position of the inner drill string relative to the outer drill string. This measurement can be made for each individual drill rod, and the control algorithm can calculate a compensation factor for each drill rod based on the measured position of the end of the inner drill string.

For drill heads without a fixed connection to the inner drill string the process is slightly different. There is no need, in that case, to vary the position of the vises to compensate for the variation in length of the inner rod drill string. The upper vise assembly 2600 and 2800 can be set at a fixed position. The inner rod driver will need to be positioned to properly align the inner rod with the vises by either adjusting the position of the main carriage as a function of the offsets measured by transducers 3030 and transducer 3020, without changing the position of the inner rod driver relative to the outer rod driver, or alternately, the inner rod driver can be fully extended, and the carriage positioned at a predetermined location relative to the position of the vise assembly.

Figure 14C:
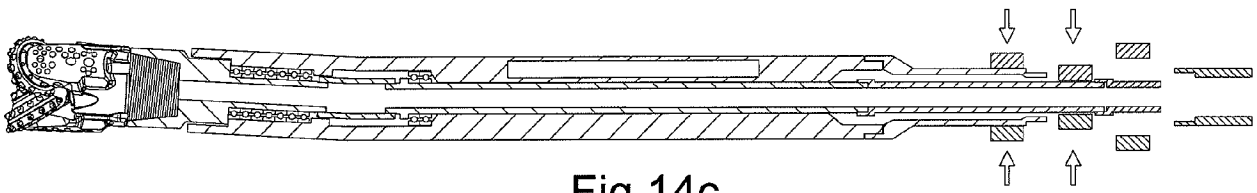
Figure 14D:
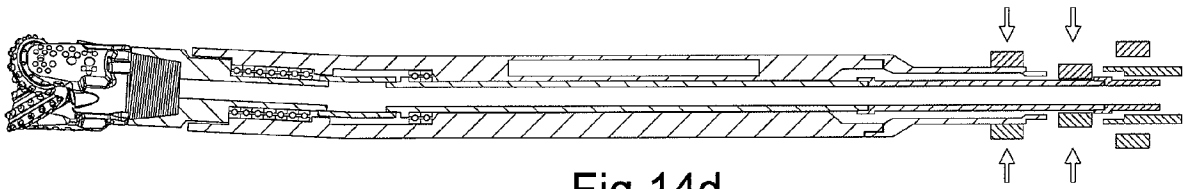
Figure 14E:
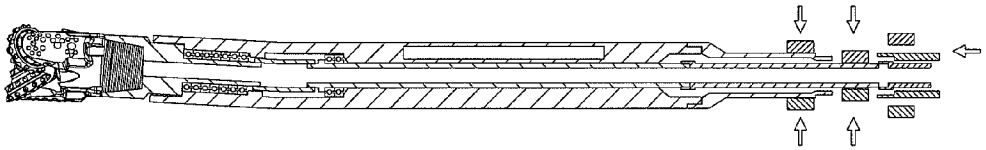
Figure 14F:
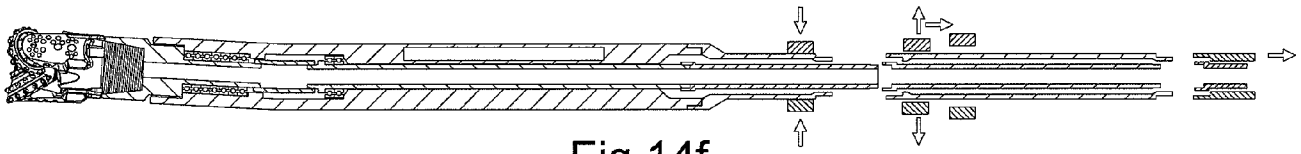
Figure 14G:
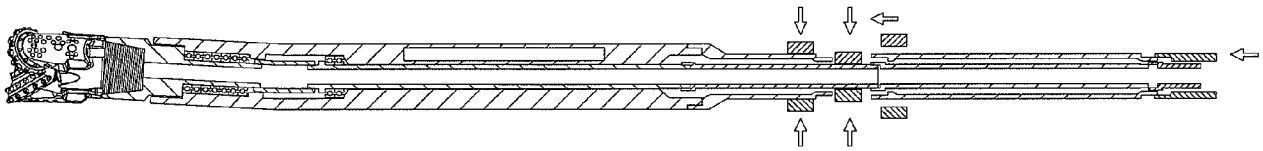
Figure 14H:
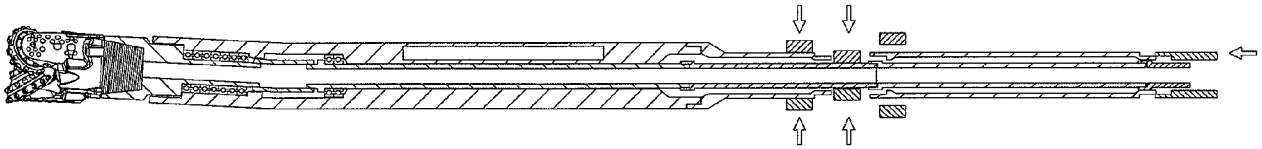
Figure 14I:
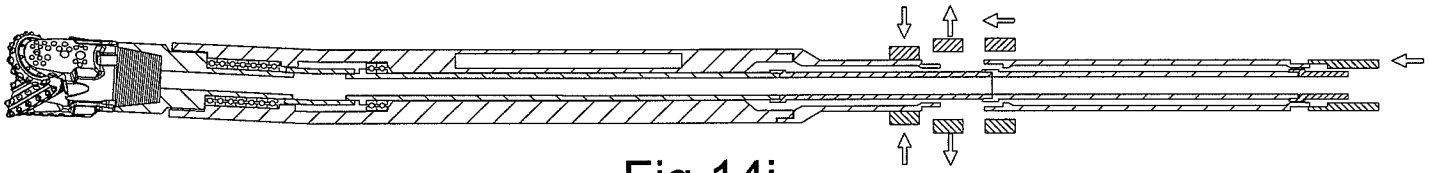
Figure 14J:
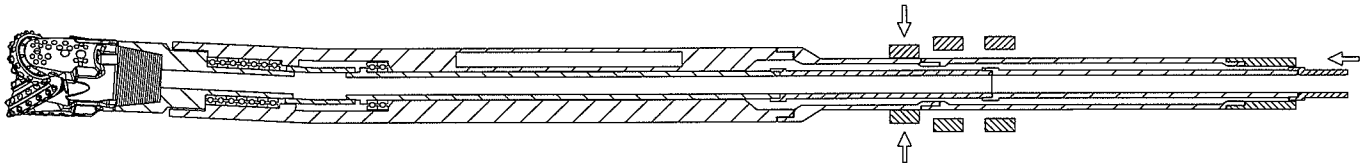
Figure 14K:
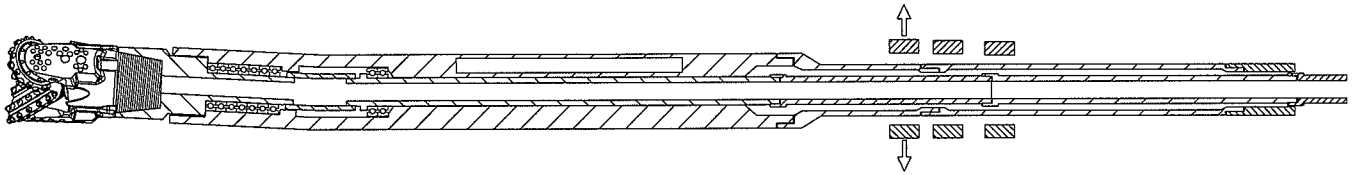

Returning to the description of the make-up process illustrated in FIG. 14, the vise carriage is properly positioned and middle vise clamps the inner drill string in FIG. 14*c*. The carriage is moved in FIG. 14*d* to move the outer rod driver adjacent the middle vise, and to position the inner and outer rod drive spindles in preparation to add a new drill rod. The inner rod driver is unthreaded from the inner drill string in FIG. 14*e* and moved back to make room to add a new drill rod as illustrated in FIG. 14*f*. In the depicted embodiment, in order to place the new drill string in place, the illustrated process includes the step of opening the middle vise, and then repositioning the vise carriage to move the vise assembly so that the rod loading mechanism can clear the vise assembly. Once the new drill rod is in position, the vise carriage moves so that the middle vise is aligned with the new joint, and it clamps the inner rod of the drill string, as shown in FIG. 14*g*. The inner rod driver then rotates, and then moves longitudinally to thread-up the new rod to both the drill string and to the inner rod driver, as illustrated in FIG. 14*h*. Once the inner rod is properly torqued, the middle vise opens and the vise carriage moves the vise assembly to its lowest positions as illustrated in FIG. 14*i*. The carriage then advances to complete the thread-up of the outer rod to the outer drill string, as illustrated in FIG. 14*j*, and the lower vise is opened in FIG. 14*k* to complete the make-up sequence.

Figures 15A, 15B, 15C, 15D:
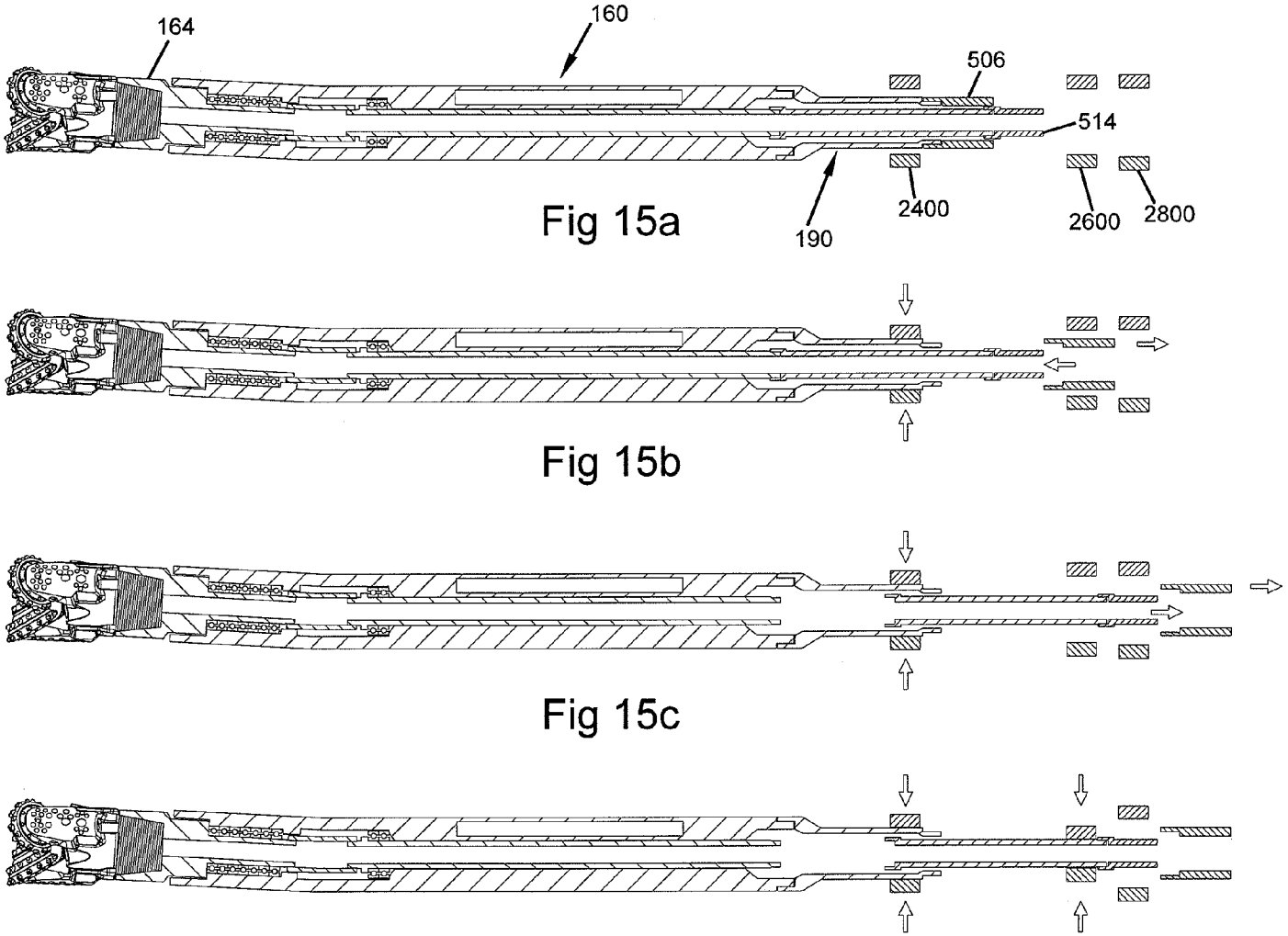
FIGS. 15*a*-15*j* illustrate the sequence of operations to add a drill rod with a drill head of a second configuration.
Figure 15E:
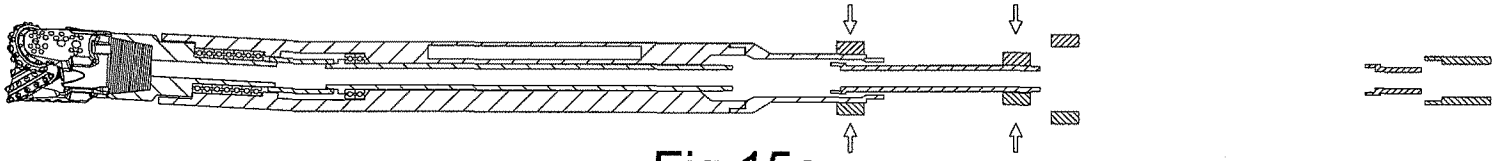
Figure 15F:
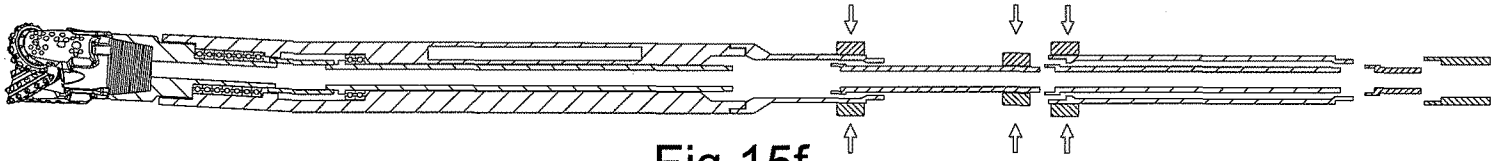
Figure 15G:
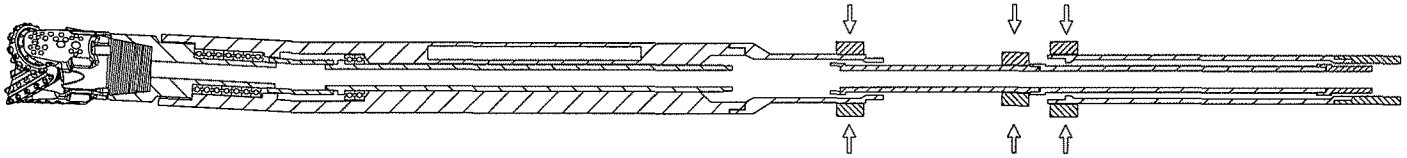
Figure 15H:
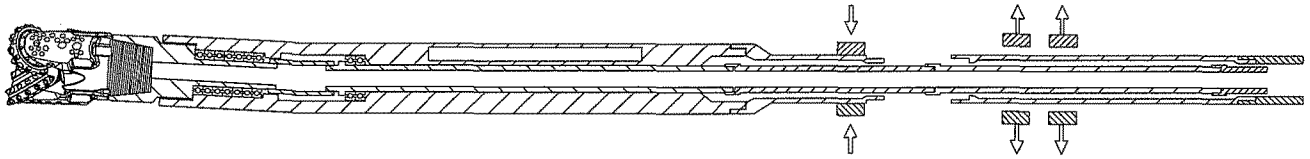
Figure 15I:
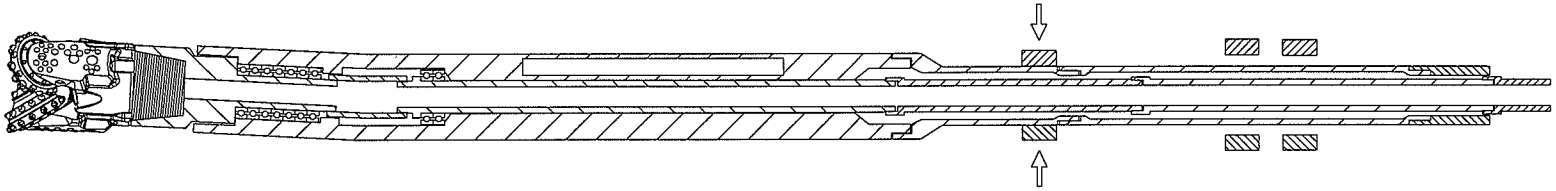
Figure 15J:
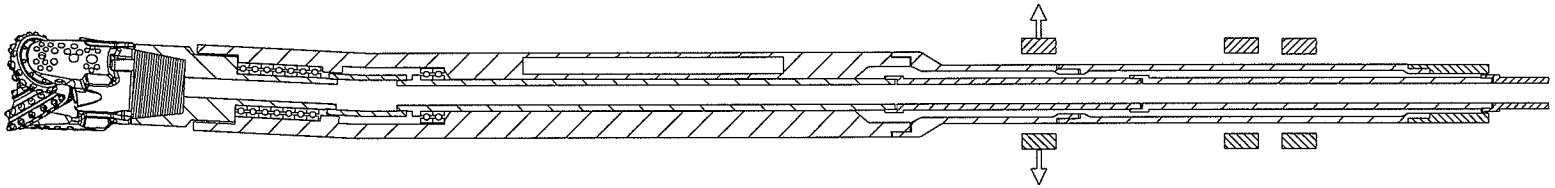

The make-up sequence with a drill head configured with a non-rigid connection to the inner drill string is illustrated in FIGS. 15*a*-15*j*, starting in the same configuration as illustrated in FIG. 14*a*, with the drivers positioned adjacent the lower vise. The lower vise clamps the outer drill string and the outer vise driver is reversed in FIG. 15*b* to expose the inner drill sting. The inner drill string is then pulled back by the inner driver in FIG. 15*c*, as is possible due to the non rigid connection to the drillhead, and into alignment with the middle and upper vises. In FIG. 15*d* the middle vise clamps the inner drill string. The inner driver is reversed and the carriage moves the drivers to make room for a new drill rod in FIG. 15*e*. The new drill string is added in FIG. 15*f* and in FIG. 15*g* the carriage moves the drivers down to engage the drivers with the inner and outer rods of the new rod, and to engage the inner rod of the new drill rod with the inner drill string. FIG. 15*h* illustrates the middle vise opening, and the drivers moving the rod towards the drill string. The inner driver moves the inner drill string back towards the drill head, and engages the non-rigid coupling to the drill head. FIG. 15*i* illustrates the subsequent step where the outer rod driver rotates and torques the outer rod with the outer drill string, and FIG. 15*j* illustrates the final step of opening the lower vise.

FIGS. 16*a*-16*n* illustrate the sequence of breaking-out a drill rod, with a drill head wherein the inner rod is rigidly attached to the inner drive shaft of the drill head, starting at FIG. 16*a* with the inner and outer rod drivers retracted to the position where the joint between the outer rod of the drill rod to be removed is positioned adjacent the lower vise, as described previously. Once the outer rod is in the correct position, the lower vise is clamped, and the middle vise is clamped and rotated in a first direction. The direction of rotation will be as required to unthread the drill rod from the drill string. With a right-handed thread, the middle vise will rotate so the top will rotate out of the paper, and the bottom of the vise will rotate into the paper as illustrated in this figure. Once the joint is broken, reverse rotation of the outer rod driver will rotate the outer rod, and the joint adjacent the lower vise will separate as the outer rod driver is moved back longitudinally, as illustrated in FIG. 16*b*. The vise carriage will be repositioned, as described earlier, to position the middle and upper vise into alignment with the joint in the inner rod, as illustrated in FIG. 16*c*, and the vises clamped onto the inner rod as illustrated in FIG. 16*d*. If the inner drill rod has threads of the same direction as the threads in the outer rod, the embodiment illustrated having right hand threads, the middle vise will then rotate in the direction opposite the direction used to break the outer rod. FIG. 16 illustrates the middle vise rotating so that the top will rotate into the paper, while the bottom will rotate out of the paper. This sequence is beneficial in that it minimizes unnecessary movements of the middle vise, allowing it to start from a home position, rotate in a first direction to break the outer rod, and then rotating in the opposite direction to break the inner rod, and to arrive back at the home position. This is also beneficial for the gearbox, in that during the step of breaking the inner rod the gearbox and drive motors are fixed, are not rotated, while the drill string and drill bit are allowed to rotate.

Once the inner rod is broken, the upper vise is opened, and the outer rod driver can be moved back down, to move the outer rod back towards the upper vise, as illustrated in FIG. 16*e*. The inner rod driver can be reversed both in rotation and longitudinally to separate the inner rod from the drill string as illustrated in FIG. 16*f*. Once the drill rod is separated from the drill string, the middle vise can be opened as shown in FIG. 16*g*, and then moved to align with the lower end of the drill rod as shown in FIG. 16*h*. Once properly aligned, the middle and upper vises clamp both inner and outer rods of the drill rod being removed as illustrated in FIG. 16*i*, and the rod drivers are reversed in both rotation and longitudinally to separate from the rod. Once separated the vises can open as illustrated in FIG. 16*j*, and the rod loading system will be used to remove the separated or broken out drill rod. The vise carriage will move the middle and upper vises back down as illustrated in FIG. 16*k*, and the middle vise will clamp on the inner drill string as illustrated in FIG. 16*l*, while the inner rod driver is threaded to the drill string. The outer rod driver can be moved back to the position where the inner rod driver is fully extended at this point, in order to allow the control system to calculate an inner drill string length compensation factor based on the data from the encoder, as described earlier. Once the inner driver is fixed to the inner drill string, the middle vise can open, allowing the outer driver to engage with the outer drill string as illustrated in FIG. 16*m*. Once secured, the process is completed when the lower vise opens, as illustrated in FIG. 16*n*.

FIGS. 17*a*-17*n* illustrate the breakout sequence with a drill head wherein the inner drill string is not rigidly connected to the inner drive shaft of the drill head staring with the outer rod properly positioned with the joint adjacent the lower vise. The lower vise is then clamped, while the middle vise is clamped and rotated in a first direction to break the outer rod. The sequence illustrated in this simplified schematic shows the middle vise clamping the outer rod in a position where it is not adjacent the lower vise. This will work for some types of outer rods. However, with other types of outer rods, that have an upset section in the vicinity of the threaded joints, it will be necessary to position the middle vise adjacent the lower vise during this step. Thus, although not illustrated, the vise assembly of the present invention, with the ability to move the middle and upper vises longitudinally, is capable of operation with a wide variety of rod types. Once the outer rod is broke, the middle vise is released, while the rod drivers pull the drill rod back to expose the inner rod and to align the inner rod joint between the middle and upper vises as illustrated in FIG. 17*b*, which results in separation of the joint between the inner drill string and the inner drive shaft of the drill head. The middle and upper vises are clamped, and the middle vise rotated in the opposite direction as illustrated in FIG. 17*c* to break the inner rod. The upper vise is opened, while the middle vise remains clamped, and the inner rod driver is reversed in rotation and longitudinally to separate the inner rod, as illustrated in FIG. 17*d*. Once separated from the drill string the upper vise is clamped onto the inner rod as illustrated in FIG. 17*f*, and the inner driver is reversed in rotation and longitudinally to separate the driver from the inner rod, as illustrated in FIG. 17*f*. The upper vise is opened and the outer rod driver moves the outer rod back down into the upper vise as illustrated in FIG. 17*g*. The upper vise clamps the outer rod while the outer rod driver reverses both in rotation and longitudinally to separate from the drill rod, as illustrated in FIG. 17*h*. The upper vise is opened and the drill rod free to be removed as illustrated in FIG. 17*i*. Once the drill rod is removed the drivers will move back down so that the inner driver can reengage the inner drill string as illustrated in FIG. 17*j*. That joint is torqued as illustrated in FIG. 17*k*. The middle vise is opened and the drivers will move back down while the inner rod driver is used to reengage the coupling between the inner drill string and the inner drive shaft of the drill head, as illustrated in FIG. 17*l*. The outer rod driver is then advanced and rotated to thread-up to the outer drill string as illustrated in FIG. 17*m*, and the sequence terminates when the lower vise opens as illustrated in FIG. 17*n*.

The above specification, examples and data provide a complete description of the manufacture and use of the composition of the invention. Since many embodiments of the invention can be made without departing from the spirit and scope of the invention, the invention resides in the claims hereinafter appended.

We claim:

1. A directional drill comprising:

a drill string drive assembly including:

a vise assembly including a lower vise, an upper vise, and a middle vise, wherein the middle vise is positioned between the upper vise and the lower vise, and wherein at least the middle vise is configured to rotate about a longitudinal drill string axis, and wherein both the middle vise and upper vise are longitudinally movable relative to the lower vise; and a drive unit configured to move towards and away from the vise assembly in a longitudinal direction, wherein the drive unit includes an inner drive shaft and an outer drive shaft, wherein the inner and outer drive shafts are coaxially arranged and configured to rotate independent from each other, and wherein the inner and outer drive shafts of the drive unit are configured to extend and retract relative to each other.

2. The directional drill of claim 1, further comprising a controller that controls the longitudinal position of at least one of the lower vise, upper vise, or middle vise relative to a drill string.

3. The directional drill of claim 2, further comprising a plurality of position sensors that are operatively connected to the controller.

4. The directional drill of claim 3, wherein at least one of the plurality of position sensors senses the location of at least one of the upper vise, lower vise, or middle vise.

5. The directional drill of claim 2, further comprising a position encoder that is operatively connected to the controller, wherein the position encoder is configured to at least provide information regarding the longitudinal position of the drive unit.

6. The directional drill of claim 5, wherein the controller is configured with control logic that enables the controller to determine the position of inner and outer rods of the drill string based on the position of the inner drive shaft and outer drive shaft of the drive unit.

7. The directional drill of claim 2, further comprising a transducer that is operatively connected to the controller and is configured to provide information regarding the longitudinal position of the drill string.

8. The directional drill of claim 1, further comprising a hydraulic cylinder and a transducer, wherein the hydraulic cylinder is configured to move at least one of the lower vise, upper vise, and middle vise in the longitudinal direction, and wherein the transducer is configured to provide data relating to the position of the at least one of the lower vise, upper vise, and middle vise that is configured to move in the longitudinal direction.

9. The directional drill of claim 1, wherein the inner and outer drive shafts are threaded.

10. The directional drill of claim 1, wherein the middle vise is selectably rotatable relative to a first direction and a second opposite direction about the longitudinal drill string axis, the middle vise being capable of generating torque sufficient to initiate break-out when rotated in either the first direction or the second direction.

11. A directional drill comprising:

a rack frame;

a carriage configured to move along the rack frame;

a drill string drive assembly mounted to the carriage including a drive unit that includes an outer drive system with an outer drive spindle that is in a fixed longitudinal position relative to the carriage and an inner drive system with an inner drive spindle that is coaxial with the outer drive spindle, configured to rotate independent of the outer drive spindle and move longitudinally relative to the outer drive spindle at least four inches;

a vise assembly including a lower vise, an upper vise, and a middle vise, wherein the middle vise is positioned between the upper vise and the lower vise, and wherein at least the middle vise is configured to rotate about a longitudinal drill string axis, and wherein both the middle vise and upper vise are longitudinally movable relative to the lower vise;

a plurality of position sensors that are operatively connected to a controller, wherein at least one of the plurality of position sensors senses the location of at least one of the upper vise, lower vise, or middle vise; and a position encoder that is operatively connected to the controller, wherein the position encoder is configured to at least provide information regarding the longitudinal position of the drive unit, the controller being configured to determine the position of inner and outer rods of the drill string based on the position of the inner drive spindle and outer drive spindle and configured to control the relative position of at least two vises of the given vise assembly.

12. The directional drill of claim 11, wherein the inner drive spindle is configured to move longitudinally relative to the outer drive spindle at least twelve inches.

13. The directional drill of claim 11, wherein the inner drive spindle is configured to rotate inner rods of a dual rod drill string, and the outer drive spindle is configured to rotate outer rods of the dual rod drill string.

14. A method of control of a drilling machine with a rack, a vise assembly having a first vise in a fixed position and second and third vises that are movable, a drill string drive assembly with an inner rod driver mounted on a carriage that moves longitudinally along the rack and an outer rod driver mounted on a carriage that moves longitudinally along the rack such that the inner rod driver can move longitudinally relative to the outer rod driver and a dual rod drill string, the method comprising:

sensing the location of at least one of the first vise, second vise, or third vise using a plurality of position sensors;

sensing the longitudinal position of the inner rod driver and the outer rod driver using a position encoder;

calculating an inner drill string length compensation factor based on a measurement of the position of the inner rod driver when the inner rod driver is connected to the drill string; and longitudinally positioning the second and third vises with respect to the rack based at least in part on the drill string length compensation factor.

15. The method of claim 14, wherein the inner drill string compensation factor is calculated by positioning the inner rod driver at a known position relative to the outer rod driver when the inner rod driver is being connected to the drill string.

16. The method of claim 15, wherein the inner drill string compensation factor is calculated based on the relative position of the inner rod driver to the outer rod driver when both are secured to the drill string.

17. A method of removing a rod from a drill string comprising:

aligning a first vise with a down hole end of a drill rod and a second vise with an up hole end of a drill rod, wherein the step of aligning includes moving the first vise relative to the second vise;

clamping the down hole end of a drill rod to be removed with the first vise;

clamping the up hole end of a drill rod that is adjacent and directly connected to the drill rod to be removed with the second vise; and rotating the up hole end of the drill rod that is directly connected to the drill rod to be removed with the second vise while preventing rotation of the drill rod to be removed with the first vise, wherein the drill rod clamped by the first vise and the drill rod clamped by the second vise are inner rods in a drill string configuration that includes coaxially arranged inner drill rods and outer drill rods.

18. The method of claim 17, wherein the step of rotating the up hole end of the drill rod that is adjacent and directly connected to the drill rod to be removed with the second vise while preventing rotation of the drill rod to be removed with the first vise loosens a threaded connection between the up hole end of the drill rod that is adjacent and directly connected to the drill rod to be removed and the down hole end of the drill rod to be removed.

19. The method of claim 18, further comprising the step of unclamping the down hole end of the drill rod to be removed after the rotating step and unthreading the connection between the down hole end of the drill rod to be removed from the uphole end of the drill rod that is adjacent and directly connected to the drill rod by rotating the drill rod to be removed with the drive unit.

20. The method of claim 17, wherein the step of rotating the up hole end of the drill rod that is adjacent and directly connected to the drill rod to be removed with the second vise while preventing rotation of the drill rod to be removed causes rotation of at least a portion of the drill string down hole of the drill rod that is adjacent and directly connected to the drill rod to be removed.

21. The method of claim 17, further comprising the step of retracting an outer rod member to expose a junction between the up hole end of the drill rod that is adjacent and directly connected to the drill rod to be removed and the down hole end of the drill rod to be removed.

22. The method of claim 21, further comprising clamping an up hole end of an outer rod member with a third vise thereby preventing the outer rods from moving while the connection between the inner rod members are broken.

* * * * *